US007178915B2

(12) United States Patent
Nakashima et al.

(10) Patent No.: US 7,178,915 B2
(45) Date of Patent: Feb. 20, 2007

(54) INK-JET RECORDING APPARATUS

(75) Inventors: Atsuhisa Nakashima, Nagoya (JP); Susumu Kuzuya, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/878,013

(22) Filed: Jun. 29, 2004

(65) Prior Publication Data

US 2004/0263602 A1 Dec. 30, 2004

(30) Foreign Application Priority Data

Jun. 30, 2003 (JP) ..... 2003-188998

(51) Int. Cl.
*B41J 2/165* (2006.01)

(52) U.S. Cl. ..... 347/104; 347/22; 271/198

(58) Field of Classification Search ..... None
See application file for complete search history.

(56) References Cited

U.S. PATENT DOCUMENTS

| | | | | |
|---|---|---|---|---|
| 5,040,000 | A | 8/1991 | Yokoi | |
| 5,274,399 | A * | 12/1993 | Uchida et al. | 346/134 |
| 5,467,114 | A | 11/1995 | Ebinuma et al. | |
| 5,534,897 | A * | 7/1996 | Anderson et al. | 347/32 |
| 5,557,306 | A | 9/1996 | Fukushima et al. | |
| 6,158,839 | A | 12/2000 | Fukushima et al. | |
| 6,578,945 | B2 | 6/2003 | Hashi et al. | |
| 6,692,101 | B2 * | 2/2004 | Lodal et al. | 347/33 |
| 2001/0012030 | A1 | 8/2001 | Midorikawa | |
| 2004/0104961 | A1 | 6/2004 | Hashi et al. | |
| 2004/0246322 | A1 | 12/2004 | Sugaya et al. | |
| 2005/0041059 | A1 * | 2/2005 | Nakashima et al. | 347/29 |

FOREIGN PATENT DOCUMENTS

| | | |
|---|---|---|
| JP | A-02-48958 | 2/1990 |
| JP | A-04-053752 | 2/1992 |
| JP | A-07-096604 | 4/1995 |
| JP | 07266570 A * | 10/1995 |
| JP | A-11-342632 | 12/1999 |
| JP | A-2000-062151 | 2/2000 |
| JP | A-2001-071521 | 3/2001 |
| JP | A-2001-270136 | 10/2001 |
| JP | A 2001-287377 | 10/2001 |
| JP | A-2002-059559 | 2/2002 |
| JP | A-2002-120386 | 4/2002 |
| JP | A 2002-120386 | 4/2002 |
| JP | A-2002-355982 | 12/2002 |
| JP | A-2003-165205 | 6/2003 |
| JP | 2004074554 A * | 3/2004 |
| WO | WO 03/045700 A1 | 6/2003 |

* cited by examiner

*Primary Examiner*—Daniel J. Coillia
*Assistant Examiner*—Jill E. Culler
(74) *Attorney, Agent, or Firm*—Oliff & Berridge, PLC

(57) ABSTRACT

An ink-jet head comprises a conveyance unit that forms a conveyance face on which a recording medium is conveyed, and a first moving mechanism that moves the conveyance unit. By means of the first moving mechanism, the conveyance unit selectively takes a conveyance position where the conveyance face is adjacent to an ink ejection surface, and a withdrawal position that is other than a position vertically below a maintenance unit. When the maintenance unit performs maintenance on the head, the conveyance unit is disposed in the withdrawal position.

23 Claims, 19 Drawing Sheets

INK-JET RECORDING APPARATUS

BACKGROUND OF THE INVENTION

1. Field of the Invention

The present invention relates to an ink-jet recording apparatus including a maintenance unit that performs maintenance on a printing head.

2. Description of Related Art

Recording methods using ink-jet recording apparatuses include line-type methods and serial-type methods. In the line-type methods, a paper serving as a recording medium and a line head having a width larger than or equal to that of the paper are moved relative to each other and, in this condition, the line head performs recordings. In the serial-type methods, a head performs recordings on a paper that is being conveyed along a paper conveyance direction while the head reciprocates perpendicularly to the paper conveyance direction, i.e., in a main scanning direction. In the line-type methods, the head is not required to move in a main scanning direction and therefore recordings can be performed at higher speeds than in the serial-type methods.

In either method, line type or serial type, it is necessary, in order to record high-quality images, to maintain good ink-ejection from very small nozzles formed in the head. Thus, the head is generally subjected to regular maintenance in which, more specifically, extra ink and foreign matters adhering onto an ink-ejection surface where many nozzles are formed are wiped off by use of a blade or a roller, ink containing foreign matters or air bubbles which remains within the nozzles is forcibly drained out of the nozzles, and the like.

In the serial type, since the head is constructed in a movable manner, the head can be moved along the main scanning direction beyond a recording area, where the maintenance is carried out.

On the other hand, according to a well-known technique in the line type methods, the head is moved vertically upward away from a conveyance unit that includes a conveyor belt for conveying a paper, to thereby form space between the head and the conveyance unit, into which a maintenance unit that performs maintenance on the head is inserted (see U.S. Pat. No. 6,578,945). In this technique, maintenance of the head is performed with a serial arrangement of the head, the maintenance unit, and the conveyance unit in this sequence from the top in a vertical direction.

SUMMARY OF THE INVENTION

The above-described technique for the maintenance of the head in a line-type printer may raise a problem that ink scattered or leaked out of the maintenance unit adheres to the conveyance unit, particularly to a recording-medium conveyance face of the conveyor belt included in the conveyance unit, because during the maintenance the conveyance unit is located vertically below the maintenance unit.

An object of the present invention is to provide an ink-jet recording apparatus capable of preventing ink scattered or leaked out of a maintenance unit from adhering to a conveyance unit.

According to an aspect of the present invention, there is provided an ink-jet recording apparatus for forming an image on a recording medium by ejecting ink onto the recording medium comprising a conveyance unit, an ink-jet head, a maintenance unit, a first moving mechanism, and a second moving mechanism. The conveyance unit forms a conveyance face on which the recording medium is to be conveyed. The ink-jet head has an ink ejection surface where a plurality of nozzles that eject ink are formed. The maintenance unit performs maintenance on the ink-jet head. The first moving mechanism moves the conveyance unit, so that the conveyance unit can selectively take a conveyance position where the conveyance face is adjacent to the ink ejection surface and a withdrawal position that is other than a position vertically below the maintenance unit when the maintenance unit performs maintenance. The second moving mechanism moves at least one of the ink-jet head and the maintenance unit relative to the other, so that the ink-jet head and the maintenance unit selectively have a positional relationship for maintenance where the ink ejection surface is adjacent to the maintenance unit and a positional relationship for standby where a distance between the maintenance unit and the ink ejection surface is larger than that in the positional relationship for maintenance.

In the foregoing structure, the first moving mechanism moves the conveyance unit, so that, when maintenance is performed on the head, the conveyance unit can be disposed in the withdrawal position that is other than a position vertically below the maintenance unit. As a result, it can be prevented that ink scattered or leaked out of the maintenance unit adheres to the conveyance unit.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
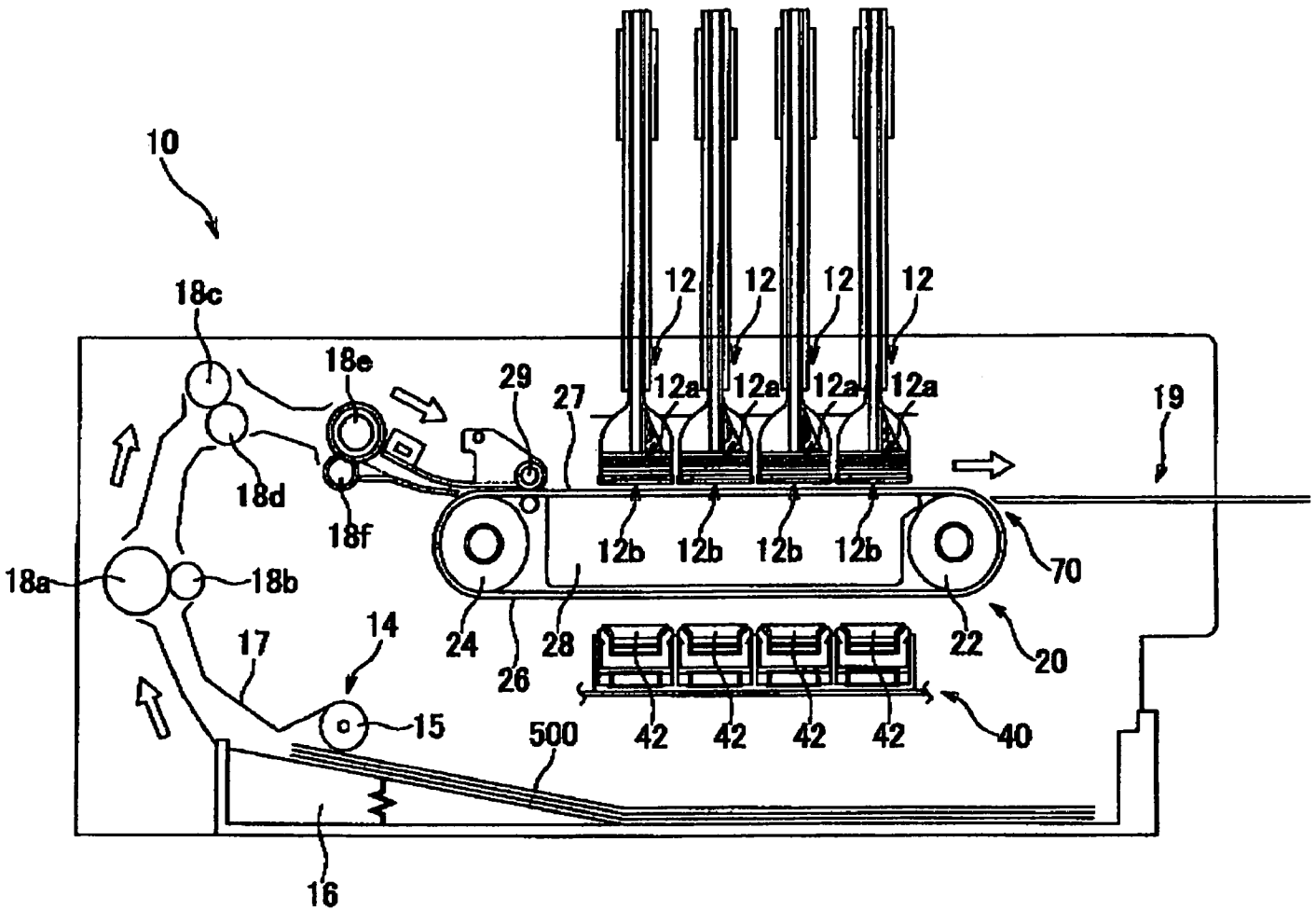
FIG. 1 is a front view showing a general structure of an ink-jet printer according to a first embodiment of the present invention.

In the following, some preferred embodiments of the present invention will be described with reference to the accompanying drawings.

First, a general structure of an ink-jet printer according to a first embodiment of the present invention will be described with reference to FIG. 1.

A printer 10 of this embodiment is a line-type color printer. More specifically, the printer 10 comprises four ink-jet heads 12 that are horizontally disposed adjacent to one another along a paper conveyance direction, and a conveyance unit 20 that is disposed vertically below the heads 12 and conveys a paper 500. Recordings are performed on the paper 500 that is being conveyed by the conveyance unit 20 under a condition where the heads 12 are fixed in their position.

The printer 10 also comprises a paper feed unit 14 and a paper discharge unit 19. As indicated by arrows in FIG. 1, a paper conveyance path, which extends from the paper feed unit 14 through space between the heads 12 and the conveyance unit 20 to the paper discharge unit 19, is formed within the printer 10.

The paper feed unit 14 includes a paper container 16 capable of accommodating a plurality of papers in a stacked manner, and a paper feed roller 15 that sends out a topmost paper 500 among the plurality of papers stocked in the paper container 16. A guide plate 17 guides the paper 500 that has been sent out by the paper feed roller 15, so that the paper 500 is delivered onto a conveyor belt 26 of the conveyance unit 20 by a first pair of rollers 18*a* and 1*b*, a second pair of rollers 18*c* and 18*d*, and a third pair of rollers 18*e* and 18*f* in this order.

A press roller 29 is disposed near an entry position of the paper 500 onto the conveyor belt 26 of the conveyance unit 20. The press roller 29 presses the paper 500 against a conveyance face 27 constituted by an outer surface of the conveyor belt 26, to thereby surely bring the paper 500 into close contact with the conveyance face 27 without separation of the paper 500 from the conveyance face 27.

Except when a maintenance unit 40, which will hereinafter be described in detail, performs maintenance on the heads 12, the conveyance unit 20 is in a "conveyance position", where the conveyance face 27 is adjacent to ink-ejection surfaces 12*b* of the heads 12 as illustrated in FIG.

The conveyance unit 20 includes two belt rollers 22 and 24, the loop-like conveyor belt 26, and a substantially rectangular parallelepiped belt guide 28. The conveyor belt 26 is wrapped around the rollers 22 and 24 to be stretched between the rollers. The belt guide 28 is disposed within a region surrounded by the conveyor belt 26. An upper portion of the belt guide 28 is in contact with an inner surface of the conveyor belt 26, and thereby supports the conveyor belt 26. The belt guide 28 is formed with substantially the same width as that of the conveyor belt 26 in a direction perpendicular to the drawing sheet of FIG. 1.

The conveyance face 27 of the conveyor belt 26 is made of silicone rubber. The press roller 29 presses the paper 500 having been conveyed thereto against the conveyance face 27 of the conveyor belt 26. Thus, the paper 500 is held on the conveyance face 27 by adhesion and, in this condition, conveyed downstream along the conveyance direction (i.e., rightward in FIG. 1) in association with rotation of the belt roller 22.

The conveyance unit 20 further includes a cleaning mechanism 50 (see FIGS. 2 and 3) that is, in FIG. 1, disposed behind the belt guide 28. The cleaning mechanism 50 will be detailed later.

A peeling plate 70 is disposed near the belt roller 22 of the conveyance unit 20 where the conveyor belt 26 is wrapped. The peeling plate 70 peels from the conveyance 5 face 27 the paper held on the conveyance face 27 of the conveyor belt 26 by adhesion.

Each head 12 has, at its bottom end, a head main body 12*a* with a rectangular section. A bottom surface of each head main body 12*a* is configured as an ink ejection surface 12*b* where many nozzles (not illustrated) for ejecting ink are formed. Magenta ink, yellow ink, cyan ink, and black ink are respectively ejected from the ink ejection surfaces 12*b* of the four head main bodies 12*a*. The ink ejection surfaces 12*b* are arranged along a horizontal direction.

The head main bodies 12*a* are disposed with their lengthwise direction, i.e., a direction perpendicular to the drawing sheet of FIG. 1, being perpendicular to the paper conveyance direction, and with narrow space formed between the ink ejection surfaces 12*b* and the conveyance face 27 that is constituted by the outer surface of the conveyor belt 26. The paper conveyance path is provided within this space between the ink ejection surfaces 12*b* and the conveyance face 27 of the conveyor belt 26. Thus, while the paper 500 conveyed by the conveyor belt 26 passes just under the four head main bodies 12*a* in order, the respective color inks are ejected through the corresponding nozzles toward a top face, i.e., a print face, of the paper 500 so that a desired color image is formed on the paper 500.

The printer 10 further comprises a maintenance unit 40 that performs maintenance on the heads 12. Except when the maintenance unit 40 performs maintenance on the heads 12, the maintenance unit 40 is in a "standby position", where a distance between the maintenance unit 40 and the ink ejection surfaces 12*b* is larger than that in a "maintenance position" which will be described later.

Particularly in this embodiment, the "standby position" is located vertically below the heads 12 and the conveyance unit 20 as illustrated in FIG. 1, and away from a path through which the conveyance unit 20 is moved as will be detailed later.

Next, referring to FIGS. 2 and 3, the conveyance unit 20 will be described in more detail.

Figure 2:
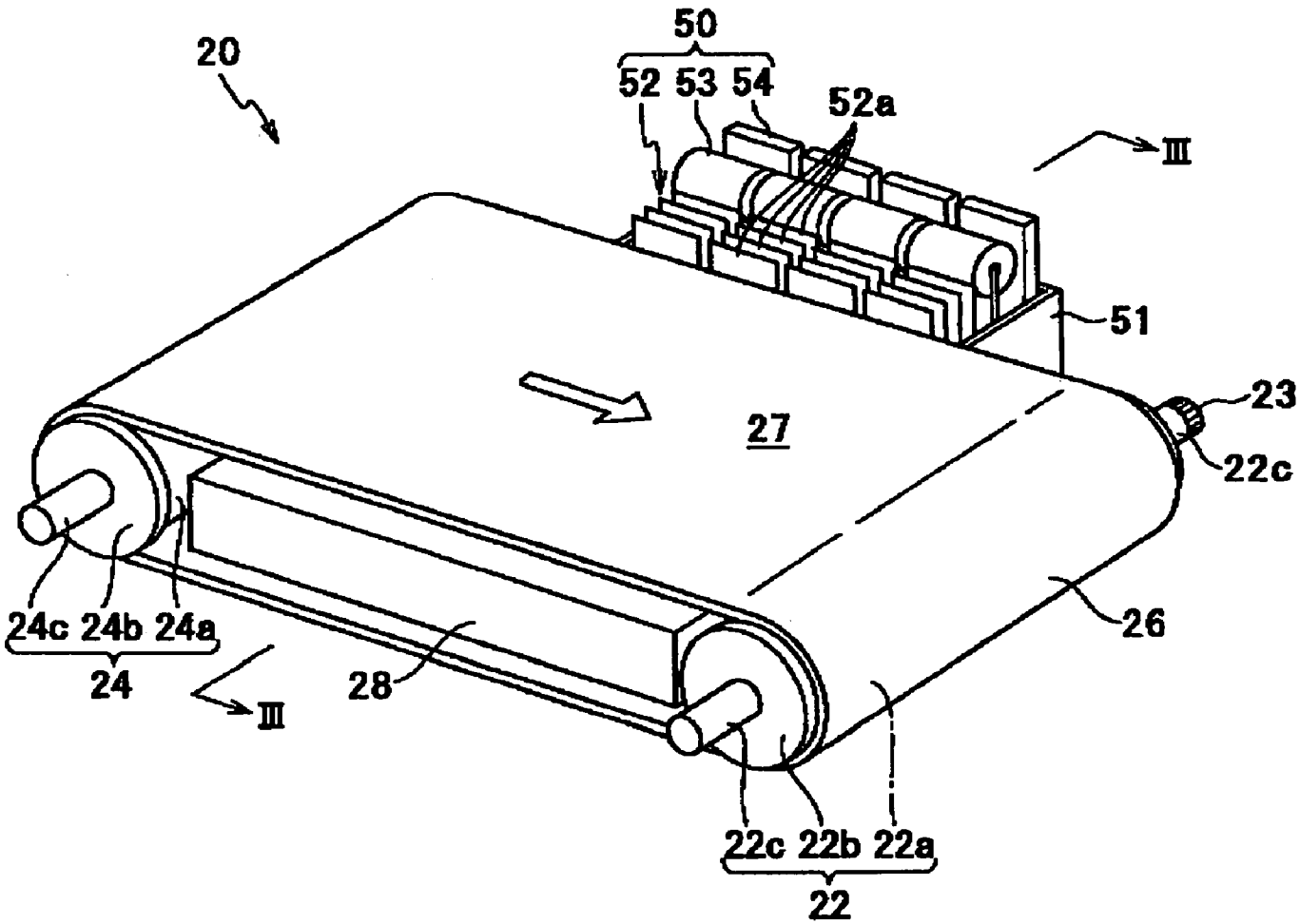
FIG. 2 is a schematic perspective view of a conveyance unit included in the printer of FIG. 1.

As illustrated in FIG. 2, the belt rollers 22 and 24 included in the conveyance unit 20 have cylindrical tubes 22*a* and 24*a*, flange portions 22*b* and 24*b*, and rotating shafts 22*c* and 24*c*. The cylindrical tubes 22*a* and 24*a* are in contact with the inner surface of the conveyor belt 26. The flange portions 22*b* and 24*b* are provided at both lengthwise ends of the tubes 22*a* and 24*a*. The rotating shafts 22*c* and 24*c* are fixed at centers of the flange portions 22*b* and 24*b*, respectively. A radius of the flange portions 22*b* and 24*b* is substantially equal to the sum of a thickness of the conveyor belt 26 and a radius of each tube 22*a* or 24*a* (see FIG. 3).

The rotating shaft 22*c* of the belt roller 22 acting as a drive roller is provided integrally with a gear 23 at one end thereof (i.e., right and posterior one in FIG. 2), so that the belt roller 22 rotates when a motor (not illustrated) drives and turns the gear 23. The rotation of the belt roller 22 drives the conveyor belt 26, which then causes rotation of the other belt roller 24 acting as a slave roller.

Figure 3:
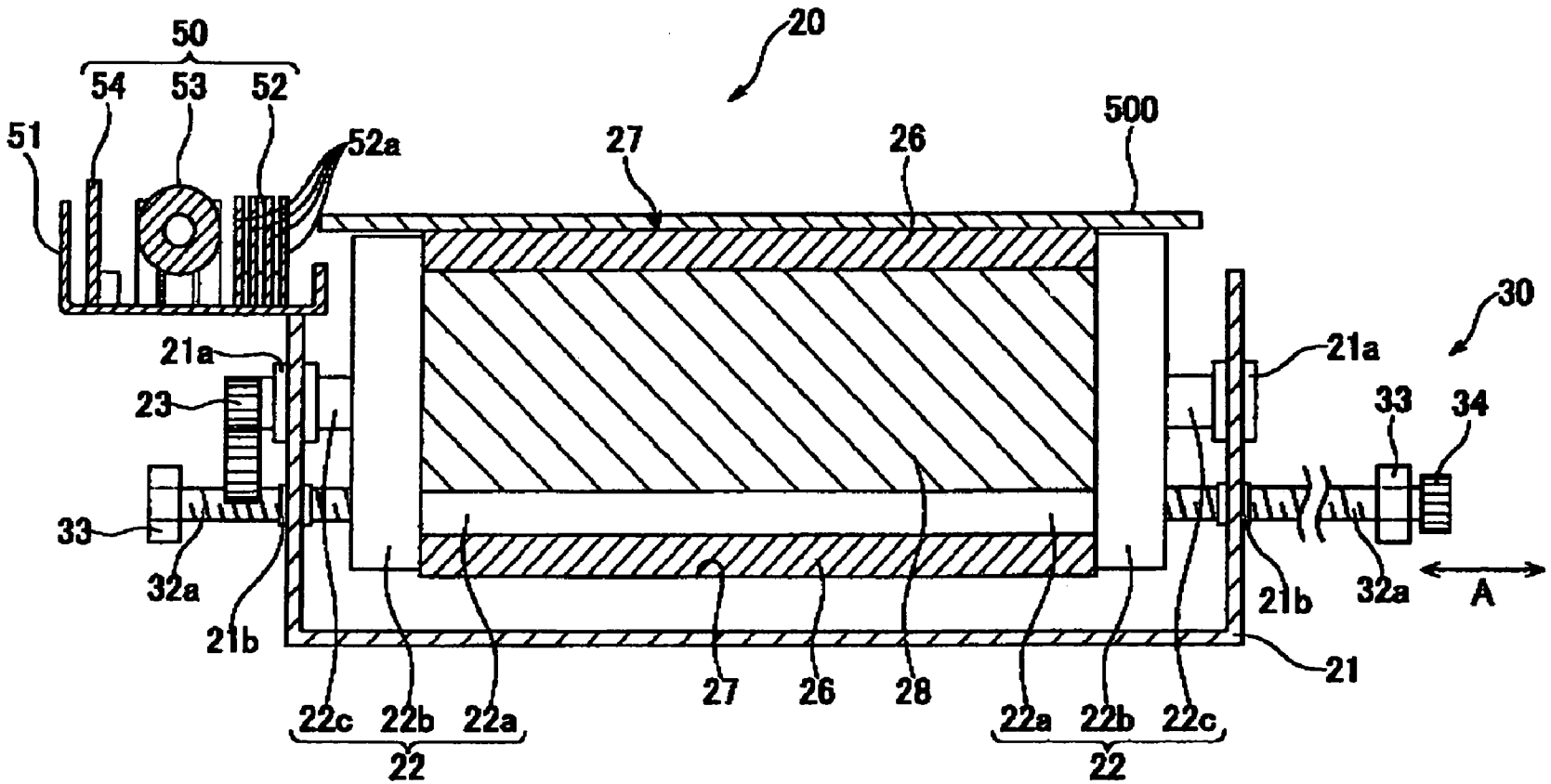
FIG. 3 is a local sectional view taken along a line III-III of FIG. 2.

The above-described elements of the conveyance unit 20, i.e., the belt rollers 22 and 24, the conveyor belt 27, and the belt guide 28, are supported on a box-shaped frame 21 with its top opened, as illustrated in FIG. 3. To be more specific, in the frame 21, bearings 21*a* that bear the rotating shafts 22*c* and 24*c* in a rotatable manner are provided at portions of both sidewalls whose planes are perpendicular to the rotating shafts 22*c* and 24*c* of the belt roller 22 and 24. These portions of both sidewalls correspond to end portions of the respective rotating shafts 22*c* and 24*c*.

As illustrated in FIG. 2, a cleaning mechanism 50 is disposed in contiguity with the conveyor belt 26 in a widthwise direction of the belt. The cleaning mechanism 50 serves to remove ink adhering onto the ink ejection surfaces 12*b* of the heads 12 (see FIG. 1), and includes an ink receiving member 52, a wiping roller 53, and a blade 54 in this order from the one nearest the conveyor belt 26. Each of these members of the cleaning mechanism 50 is supported on a frame 51, and divided into four sections each corresponding to each head 12. In addition, as Illustrated in FIG. 3, these members are put on an upper face of a bottom wall of the frame 51, and stand upward therefrom. A lower face of the bottom wall of the frame 51 is integrally attached to an upper end of one sidewall of the frame 21.

During a later-described movement of the conveyance unit 20 from a "conveyance position" into a "withdrawal position", the cleaning mechanism 50 performs an ink removal operation by means of the ink receiving member 52, the wiping roller 53, and the blade 54 in this order.

The ink receiving member 52 receives, from the ink adhering onto the ink ejection surfaces 12*b*, a relatively large amount of ink. More specifically, the ink receiving member 52 includes sixteen thin plates 52*a* in total, i.e., four for each head 12. A lengthwise direction of the thin plates 52*a* is parallel to the paper conveyance direction indicated by an arrow in FIG. 2. The thin plates 52*a* are arranged opposite to one another with narrow gaps formed therebetween in a direction perpendicular to the paper conveyance direction (i.e., a lateral direction in FIG. 3). A height of each thin plate 52*a* is so adjusted that the thin plate 52*a* may pass under the ink ejection surface 12*b* with its upper end kept at a small distance from the ink ejection surface 12*b*. The relatively large amount of ink adhering onto the ink ejection surfaces 12*b* is, at the vicinity of its lower end, brought into contact with the thin plates 52*a* under the condition where the ink receiving member 52 and the ink ejection surfaces 12*b* are not in contact with each other when the ink-ejection surfaces 12*b* pass over the ink receiving member 52. The ink thereby moves into the gaps between the thin plates 52*a* and is removed from the ink ejection surfaces 12*b*.

Both of the wiping roller 53 and the blade 54 serve to wipe off ink adhering onto the ink ejection surfaces 12*b* (see FIG. 1). The wiping roller 53 has a cylindrical shape with its outer surface made of a porous material capable of absorbing ink such as urethane. The wiping roller 53 comes into contact with the ink ejection surfaces 12*b* to, with its rotation, wipe off the ink adhering onto the ink ejection surfaces 12*b*. The blade 54 is formed of a flexible material such as urethane rubbers. The blade 54 comes into contact with the ink ejection surfaces 12*b* so that its upper end is bent, and in this condition wipes off the ink adhering onto the ink ejection surfaces 12*b*.

Next, referring to FIGS. 3 and 4, a description will be given to a conveyance unit moving mechanism 30 included in the printer 10. The moving mechanism 30 moves the conveyance unit 20 such that the conveyance unit 20 may selectively take the aforementioned "conveyance position", and the "withdrawal position" that is other than a position vertically below the maintenance unit 40 when the maintenance is performed.

Particularly in this embodiment, when viewed perpendicularly to the drawing sheet of FIG. 1, the "withdrawal position" is placed nearer to front side than the conveyance unit 20 is. When viewed in a plan view, the "withdrawal position" is at a distance from the heads 12 and the maintenance unit 40. Thus, the moving mechanism 30 horizontally moves the conveyance unit 20 in a direction parallel to the ink ejection surfaces 12*b* and perpendicular to the paper conveyance direction (i.e., in a direction indicated by an arrow A in FIGS. 3 and 4).

The moving mechanism 30 includes two supporting columns 32*a* and 32*b* (only one column 32*a* of which is shown in FIG. 3), and bearings 33. The two supporting columns 32*a* and 32*b* support the conveyance unit 20 and guide the conveyance unit 20 in its moving direction. The bearings 33 are provided at both ends of the respective supporting columns 32*a* and 32*b*, to bear the supporting columns 32*a* and 32*b* in a rotatable manner. Each of the two supporting columns 32*a* and 32*b* is an elongated member having a substantially circular section, and passes through two opposing sidewalls of the frame 21 in the direction of the arrow A.

Figure 4:
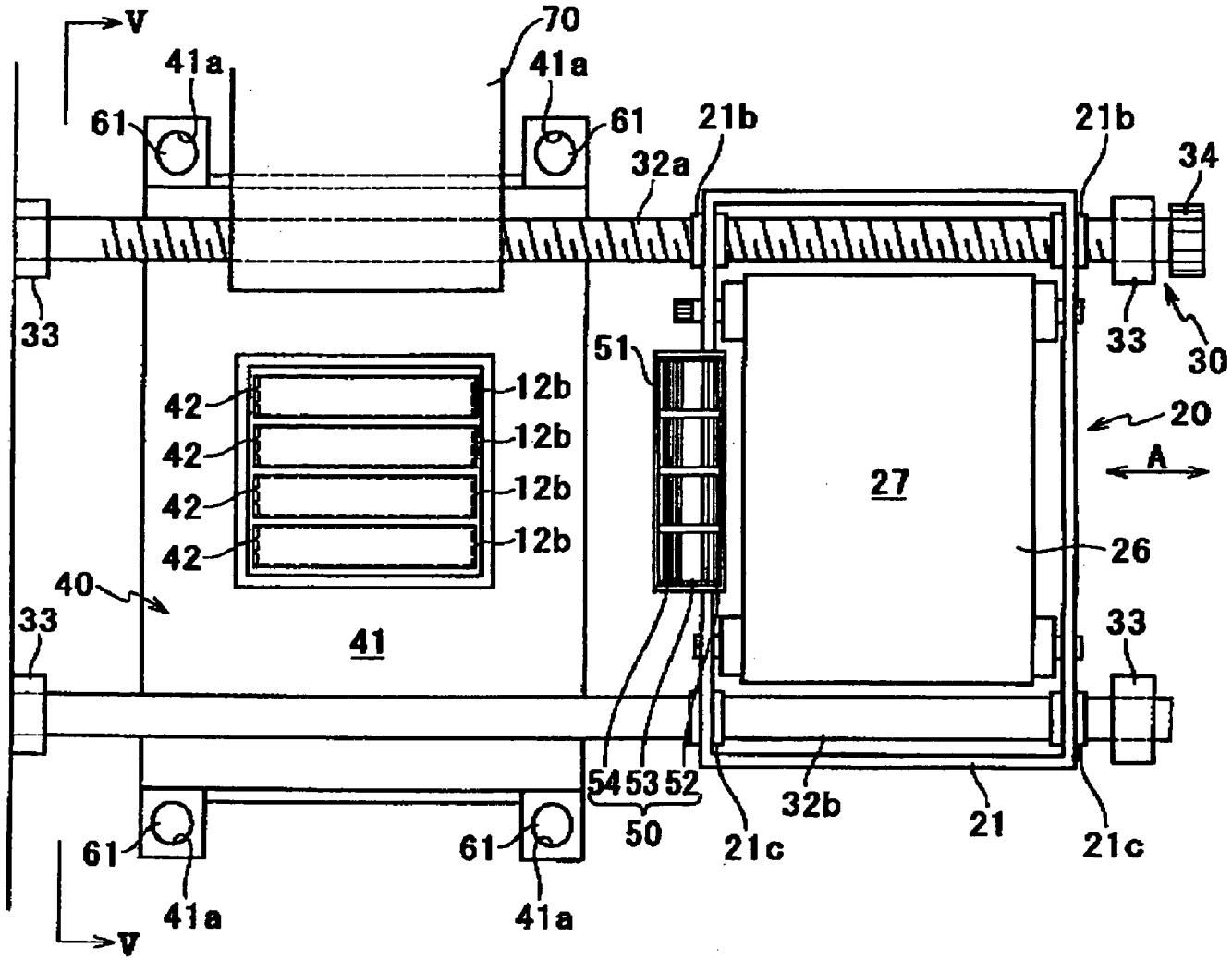
FIG. 4 is a local top view showing that a moving mechanism is moving the conveyance unit included in the printer of FIG. 1.

As illustrated in FIG. 4, one supporting column 32*a* is bolt-shaped with a screw thread formed on its outer surface, and is engaged with nuts 21*b* provided on the respective sidewalls of the frame 21. Each of the nuts 21*b* has, on its inner surface, a screw thread engageable with the screw thread of the supporting column 32*a*. The other supporting column 32*b* has a smooth outer surface with no screw thread formed thereon, and supports the conveyance unit 20 in a slidable manner via bushings 21*c* that are provided on the respective sidewalls of the frame 21. Each of the supporting columns 32*a* and 32*b* has the outer surface smoothed at its both ends, so that each supporting column can rotate within the bearings 33.

One end of the bolt-shaped supporting column 32*a* is formed integrally with a gear 34, so that the supporting column 32*a* rotates when a motor (not illustrated) drives and turns the gear 34. Since the supporting column 32*a* and the nuts 21*b* have the screw threads engageable with each other, rotation of the supporting column 32*a* displaces the nuts 21*b*. At this time, the bushings 21*c* mounted on the other supporting column 32*b* having no screw thread are also displaced in the same manner. This enables the conveyance unit 20 to move horizontally in the direction of the arrow A.

Next, the maintenance unit 40 will be described with reference to FIGS. 4 and 5. The maintenance unit 40 includes a frame 41 constituted by a substantially rectangular plate. Four purge caps 42 capable of covering the ink ejection surfaces 12*b* of the respective heads 12 are mounted on the frame 41.

The purge caps 42 receive ink forcibly drained out of the nozzles, while they cover the ink ejection surfaces 12*b*. The purge caps 42 are made of an elastic material such as rubber, and can closely contact with the ink ejection surfaces 12*b* of the heads 12 in a covering manner. The close contact of the purge caps 42 with the ink ejection surfaces 12*b* can keep the nozzles in an air-tight condition.

The purge caps 42 are connected with a sucking side of a purge pump (not illustrated). The purge caps 42 and the purge pump constitute a purge mechanism that forcibly drains out of the nozzles ink unavailable for printing. The purge pump may be mounted either on the frame 41 or at a suitable position within the printer 10. When the purge pump is operated, suction force arises within the purge caps 42. Due to this suction force, ink is drained out of the nozzles. The ink drained in this way is discharged into a waste ink reservoir (not illustrated) that is connected with a discharging side of the purge pump. By means of the above-described purge mechanism, ink containing foreign matters and air bubbles that remains within the nozzles formed in the ink ejection surfaces 12*b* are drained out of the nozzles.

Figure 5:
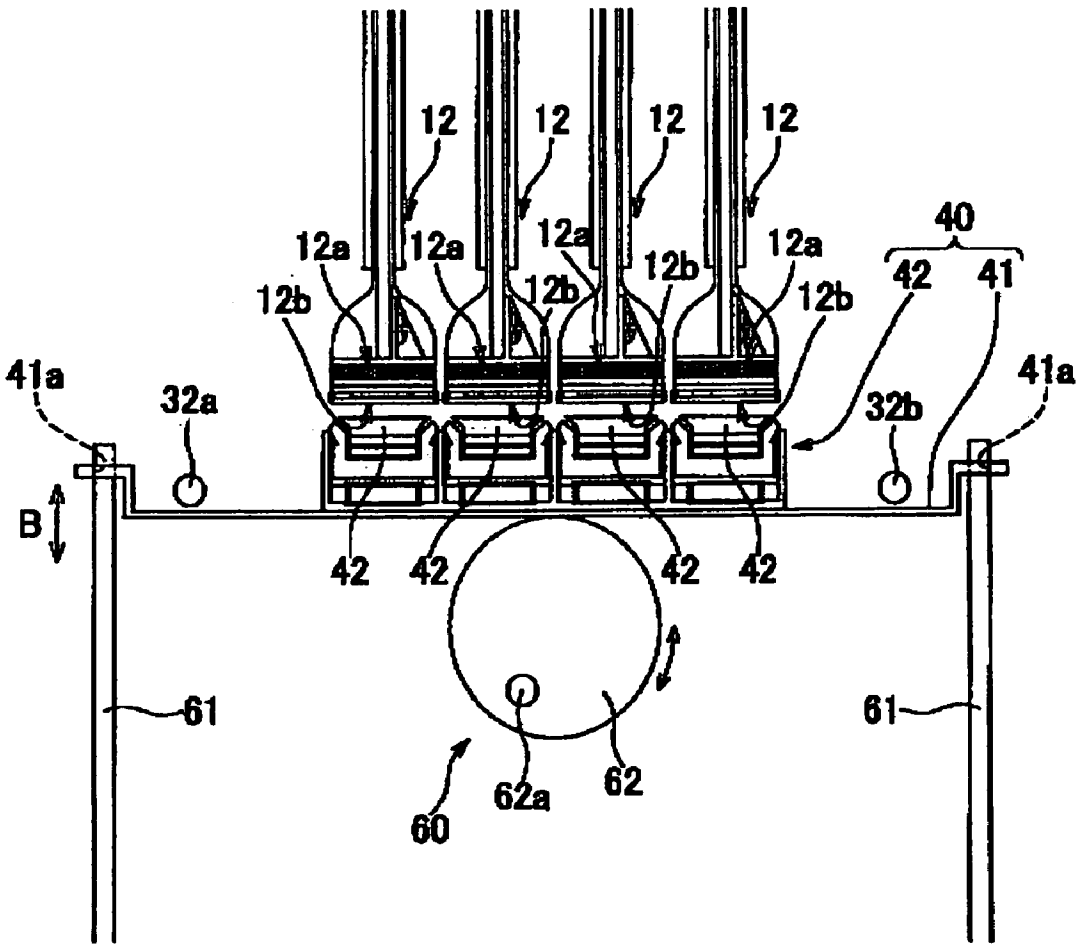
FIG. 5 is a local sectional view taken along a line V-V of FIG. 4, showing that a sliding mechanism is moving a maintenance unit included in the printer of FIG. 1.

A sliding mechanism 60 illustrated in FIG. 5 allows the maintenance unit 40 to slide in a vertical direction as indicated by an arrow B. The sliding mechanism 60 moves the maintenance unit 40 such that the maintenance unit 40 can selectively take the "maintenance position" and the aforementioned "standby position". When the maintenance unit 40 is in the "maintenance position", the ink ejection surfaces 12*b* of the heads 12 are adjacent to the maintenance unit 40, in more detail, to the purge caps 42 mounted on the maintenance unit 40.

The "maintenance position" is a position where the heads 12 can be subjected to maintenance. When the maintenance unit 40 takes the "maintenance position", the four purge caps 42 are in close contact with the respective ink ejection surfaces 12*b* of the corresponding heads 12 in a covering manner.

The sliding mechanism 60 includes four guide shafts 61 and a rotating cam 62. The four guide shafts 61 guide the maintenance unit 40 along the vertical direction B. The rotating cam 62 rotates to thereby move the maintenance unit 40 while guiding the maintenance unit 40 along the guide shafts 61. Each guide shaft 61 has a cylindrical shape and a smooth outer surface, and is slidably inserted into each of holes 41*a* formed near four corners of the frame 41. Since a rotating shaft 62*a* of the rotating cam 62 is off-center, a position of an upper end of the rotating cam 62 in the vertical direction B is changed along with rotation of the rotating cam 62. The frame 41 of the maintenance unit 40 is put on the upper end of the outer circumferential surface of the rotating cam 62. Therefore, when the rotating cam 62 rotates and the position of its upper end is accordingly changed, the maintenance unit 40 moves in the vertical direction B, while being guided along the guide shafts 61.

Then, with reference to FIGS. 6A, 6B, 6C, and 6D, there will be described how the conveyance unit 20 and the maintenance unit 40 move before maintenance is performed on the heads 12. FIGS. 6A to 6D are views seen from an upstream side in the paper conveyance direction. A state shown in FIG. 6A corresponds to a state shown in FIG. 1. FIGS. 6A to 6D show each unit in a simplified form, and omit illustrations of the conveyance unit moving mechanism 30 and the sliding mechanism 60.

The maintenance unit 40 performs maintenance on the heads 12, when the first use of the printer 10 ink is introduced from an ink supply source (i.e., a non-illustrated ink cartridge) into heads 12, and when the printer 10 is reactivated after a long-term nonuse period, etc. In this embodiment, particularly, maintenance of the heads 12 is performed by the above-described purge mechanism made up of the purge caps 42 and the purge pump (not illustrated).

Figure 6A:
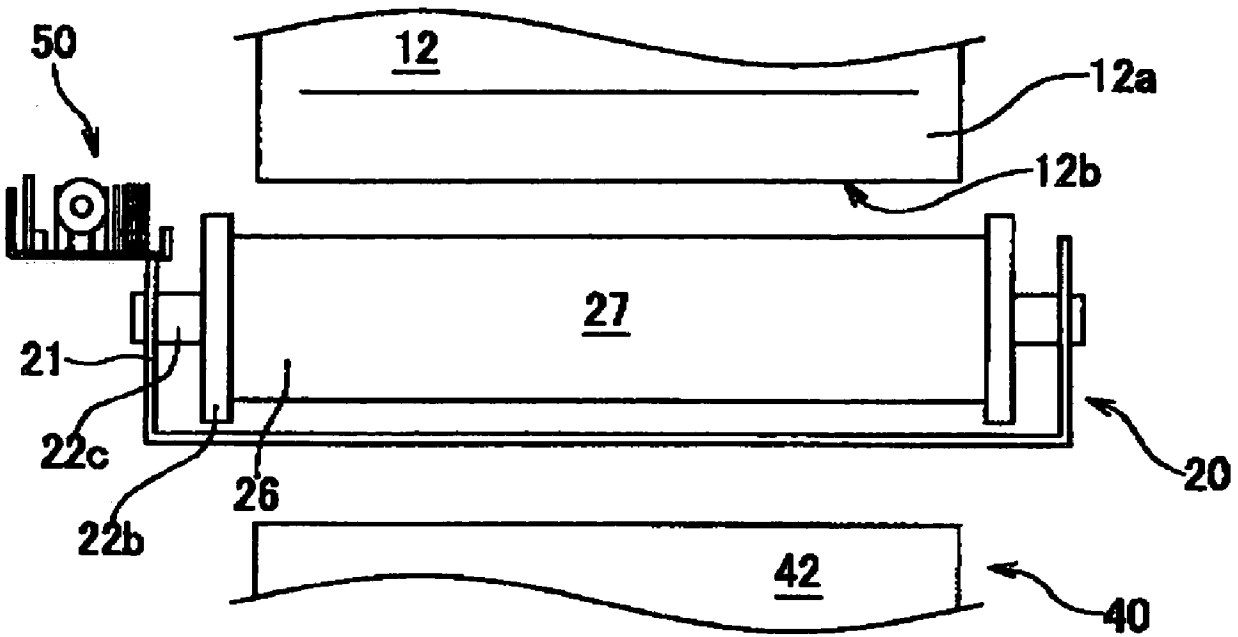
FIGS. 6A, 6B, 6C, and 6D are local side views showing stepwise respective movements of the conveyance unit and the maintenance unit included in the printer of FIG. 1, before maintenance of heads is performed.

FIG. 6A shows a state where maintenance is not performed on the heads 12. The heads 12, the conveyance unit 20, and the maintenance unit 40 are disposed in this order from the top along the vertical direction. In this state, the conveyance unit 20 takes the "conveyance position", and the maintenance unit 40 takes the "standby position".

Figure 6B:
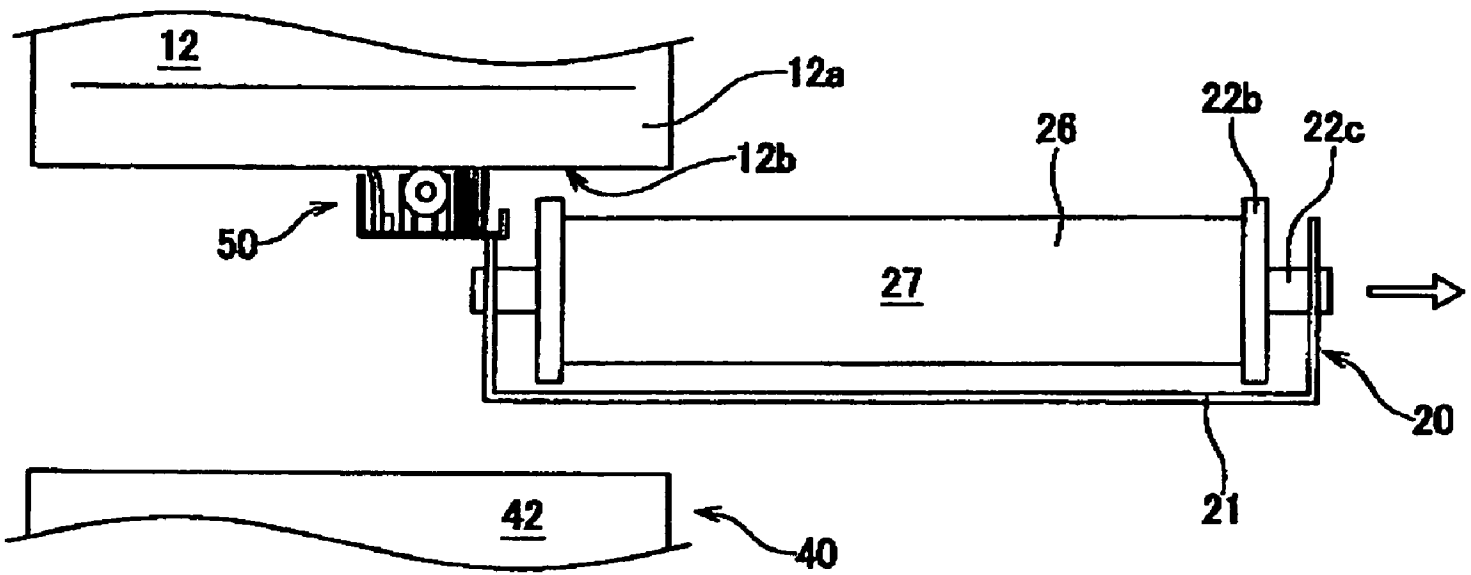
Figure 6C:
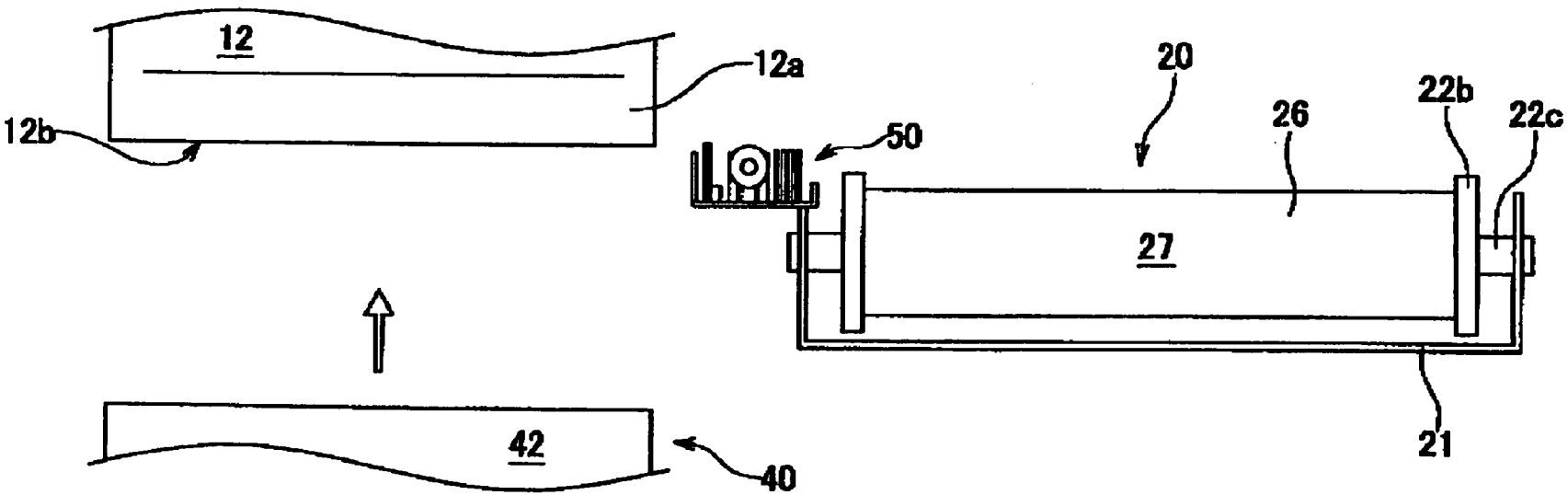
Figure 6D:
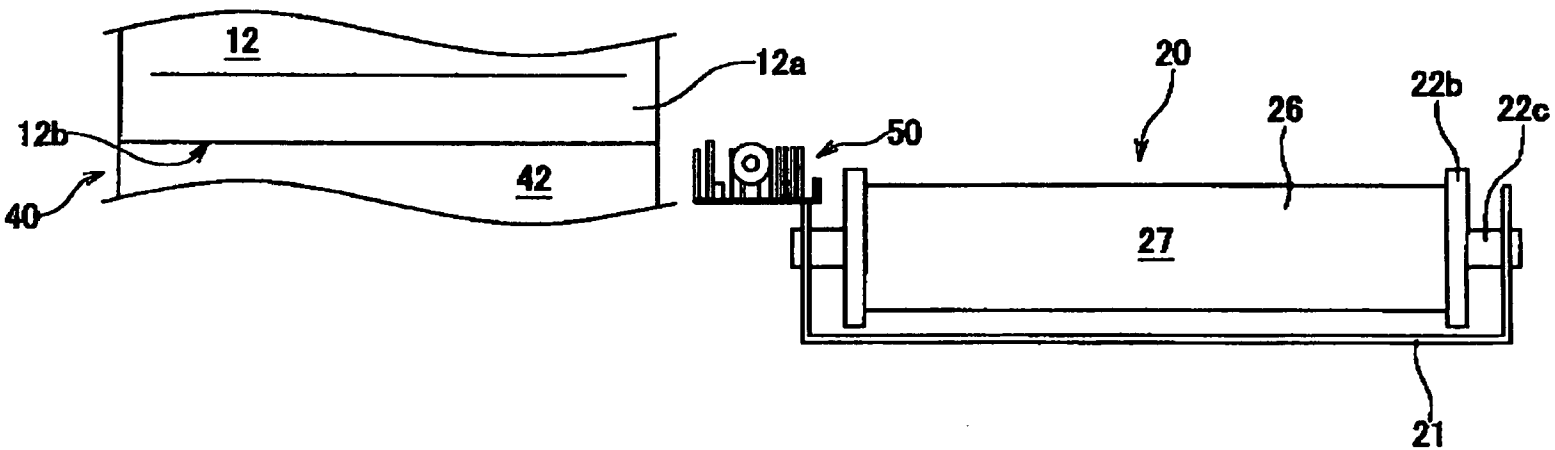

Before the heads 12 are subjected to maintenance, as shown in FIG. 6B, the conveyance unit 20 is horizontally moved In a direction (as indicated by an arrow in FIG. 6B) parallel to the ink ejection surfaces 12*b* and perpendicular to the paper conveyance direction (i.e., moved toward front side in FIG. 1). During this movement of the conveyance unit 20, the cleaning mechanism 50 included in the conveyance unit 20 is also moved relative to the heads 12. At this time, as the moving mechanism 30 (see FIGS. 3 and 4) moves the conveyance unit 20, the cleaning mechanism 50 removes ink adhering onto the ink election surfaces 12*b*.

When the conveyance unit 20 reaches the "withdrawal position", it is kept in this position. Then, the maintenance unit 40 starts moving upward in the vertical direction (see FIG. 6C). When the conveyance unit 20 is in the "withdrawal position", space where the maintenance unit 40 can be disposed is formed vertically below the heads 12. As a consequence, the maintenance unit 40 can be moved without any contact with the conveyance unit 20. When the maintenance unit 40 reaches the "maintenance position", the maintenance unit 40 is kept in this position where it performs maintenance on the heads 12 (see FIG. 6D).

After completion of the maintenance, the maintenance unit 40 is still kept in the "maintenance position" until a next printing operation. When the maintenance unit 40 is in the "maintenance position", the purge caps 42 of the maintenance unit 40 cover the ink ejection surfaces 12*b* of the heads 12, so that ink around the nozzles is prevented from getting dry.

In order to perform a next printing after the maintenance, above-described procedure is reversed. That is, at first the maintenance unit 40 is moved vertically downward into the "standby position". Subsequently, the conveyance unit 20 is horizontally moved in a direction reverse to the aforementioned one, i.e., moved leftward in FIG. 6B and moved in a direction perpendicular to the drawing sheet in FIG. 1, so that the conveyance unit 20 returns to the "conveyance position" as illustrated in FIG. 6A. During this movement of the conveyance unit 20, in the same manner as described above, the cleaning mechanism 50 included in the conveyance unit 20 removes ink adhering onto the ink ejection surfaces 12*b* of the heads 12.

As described above, in the ink-jet printer 10 according to the first embodiment of the present invention, the moving mechanism 30 moves the conveyance unit 20, so that, during the maintenance of the heads 12, the conveyance unit 20 can be disposed in the "withdrawal position" that is other than a position vertically below the maintenance unit 40. Accordingly, it can be prevented that ink scattered or leaked out of the maintenance unit 40 adheres to the conveyance unit 20, particularly to the conveyance face 27 of the conveyor belt 26 included in the conveyance unit 20. This can relieve a problem that ink unnecessarily adheres to the paper 500 conveyed on the conveyance face 27.

In addition, the conveyance unit 20 moves in the horizontal direction, and the maintenance unit 40 moves in the vertical direction. Therefore, space where a control unit (not illustrated) etc. of the printer 10 may be mounted is formed below the withdrawal position of the conveyance unit 20 and next to the paper container 16 and the standby position of the maintenance unit 40 (i.e., in front of the maintenance unit 40 and the paper container 16 in FIG. 1). Thus, effective utilization of space is realized within the printer 10, which can prevent the printer 10 from increasing in size.

Further, the moving mechanism 30 includes two supporting columns 32*a* and 32*b* (see FIG. 4), one of which 32*a* is bolt-shaped, and rotation of the column 32*a* can move the conveyance unit 20. Like this, the conveyance unit 20 can be moved by means of the moving mechanism 30 having such a relatively simple structure.

The moving mechanism 30 can adopt a relatively simple structure, because it moves the conveyance unit 20 only. For performing maintenance, moving the heads 12 as well as the conveyance unit 20 or moving only the heads 12 instead of the conveyance unit 20 requires larger space for movements of the respective members. Therefore, space within the printer 10 cannot be effectively utilized, thus possibly increasing the size of the printer 10. In this embodiment, on the other hand, since only the conveyance unit 20 is moved, space to be ensured for movement of the conveyance unit 20 is relatively small. Accordingly, the effective utilization of space is realized within the printer 10, which can prevents the printer 10 from increasing in size.

The sliding mechanism 60 (see FIG. 5) is adopted for moving the maintenance unit 40 which can therefore be moved smoothly.

Moreover, this embodiment has such an efficient structure as the conveyance unit 20 includes the cleaning mechanism 50 that removes ink from the ink ejection surfaces 12*b* along with the movement of the conveyance unit 20.

In this embodiment, particularly, the cleaning mechanism 50 removes ink adhering onto the ink ejection surfaces 12*b* of the heads 12, when the conveyance unit 20 is moved by the moving mechanism 30 both from the "conveyance position" into the "withdrawal position" and from the "withdrawal position" into the "conveyance position". That is, the ink removal by the cleaning mechanism 50 occurs both before and after the maintenance unit 40 performs the maintenance on the heads 12. This can surely keep good ink ejection from the nozzles.

Next, a general structure of an ink-jet printer according to a second embodiment of the present invention will be described with reference to FIG. 7. Here in this embodiment, the same members as those in the first embodiment will be denoted by the common reference numerals and will not be described.

This embodiment differs from the first embodiment mainly in that heads 112 instead of a maintenance unit 140 are moved with the maintenance unit 140 being fixed in its position, and a cleaning mechanism 50 is not on a conveyance unit 120, but on the maintenance unit 140. In addition, in the first embodiment the conveyance unit 20 is moved in the direction parallel to the ink ejection surfaces 12*b* and perpendicular to the paper conveyance direction, whereas in this embodiment the conveyance unit 120 is moved along the paper conveyance direction.

A printer 100 of this embodiment is, similarly to the first embodiment, a line-type color printer. More specifically, the printer 100 comprises four ink-jet heads 112 that are horizontally disposed adjacent to one another along a paper conveyance direction, and a conveyance unit 120 that is disposed vertically below the heads 112 and conveys a paper. Recordings are performed on the paper that is being conveyed by the conveyance unit 120 under a condition where the heads 112 are fixed in their position.

Similarly to the first embodiment, the printer 100 comprises a paper feed unit 114 and a paper discharge unit 19. As indicated by arrows in FIG. 7, a paper conveyance path, which extends from the paper feed unit 114 through space between the heads 112 and the conveyance unit 120 to the paper discharge unit 19, is formed within the printer 100.

The paper feed unit 114 includes a paper container 116 capable of accommodating a plurality of papers in a stacked manner, and a paper feed roller 115 that sends out a topmost paper (not illustrated) among the plurality of papers stacked in the paper container 116. A guide plate 117 guides the paper that has been sent out by the paper feed roller 115, so that the paper is delivered onto a conveyor belt 26 of the conveyance unit 120 by a first pair of rollers 118*a* and 118*b*, a second pair of rollers 118*c* and 118*d*, and a third pair of rollers 118*e* and 118*f* in this order.

A sliding mechanism 160 allows the heads 112 to slide in a vertical direction. The sliding mechanism 160 moves the heads 112 such that the heads 112 may selectively take a "printing position" and a "maintenance position" that will be described later.

The sliding mechanism 160 includes a pair of guide columns 161 and gears 163. The guide columns 161 guide the heads 112 in the vertical direction. The gears 163 rotate to thereby move the heads 112 while guiding the heads 112 along the guide columns 161. Each of the guide columns 161 has a cylindrical shape with its side face formed with a serrated rack portion 161*a*. A cross member 113 is integrally attached to the four heads 112, and has the guide columns 161 mounted thereon in the vicinity of both upstream and downstream ends thereof in the paper conveyance direction, where the guide columns 161 extend upward in the vertical direction. The gears 163 are supported on another member of the printer 100, and in this condition disposed in engagement with the rack portions 161*a* of the respective guide columns 161. A motor (not illustrated) drives and turns the gears 163. As the gears 163 turn, engagement positions between the rack portions 161*a* of the guide columns 161 and the gears 163 are changed. This makes the guide columns 161 move in the vertical direction together with the cross member 113 and the heads 112.

The conveyance unit 120 is moved by means of the same mechanism (not illustrated) as the moving mechanism 30 of the first embodiment. In this embodiment, a "withdrawal position" of the conveyance unit 120 is distinct from that of the first embodiment, and located on an upstream side of its "conveyance position".

Next, the maintenance unit 140 will be described with reference to FIGS. 7 and 8. FIG. 8 shows FIG. 7 seen from a left side thereof.

The maintenance unit 140 includes a box-shaped frame 141 with its top opened. Four purge caps 42 similar to those of the first embodiment are mounted within the frame 141. The maintenance unit 140 also includes within the frame 141 the same cleaning mechanism 50 as in the first embodiment.

Within the frame 141, a belt-type moving mechanism 180 (see FIG. 8) is further disposed within the maintenance unit 140. The belt-type moving mechanism 50 moves the cleaning mechanism 50, and includes two belts 186, two rollers 182 and 194 between which the respective belts 186 are stretched, and a motor 185 that rotates one roller 182 in order to drive the belts 186. The cleaning mechanism 50 is fixed onto the two belts 186 so that the cleaning mechanism 50 may move along with the driving of the belts 186.

Figure 7:
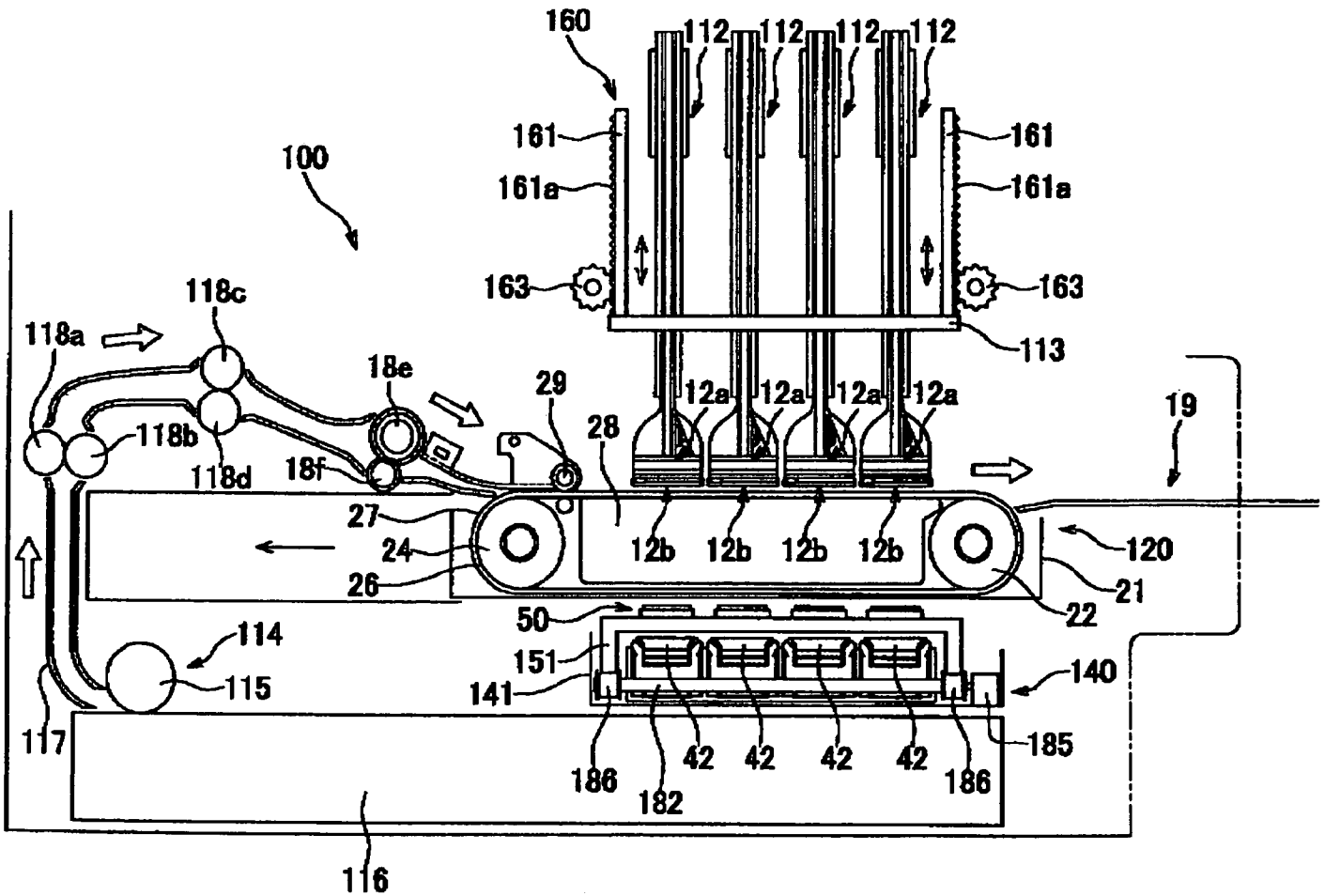
FIG. 7 is a front view showing a general structure of an ink-jet printer according to a second embodiment of the present invention.
Figure 8:
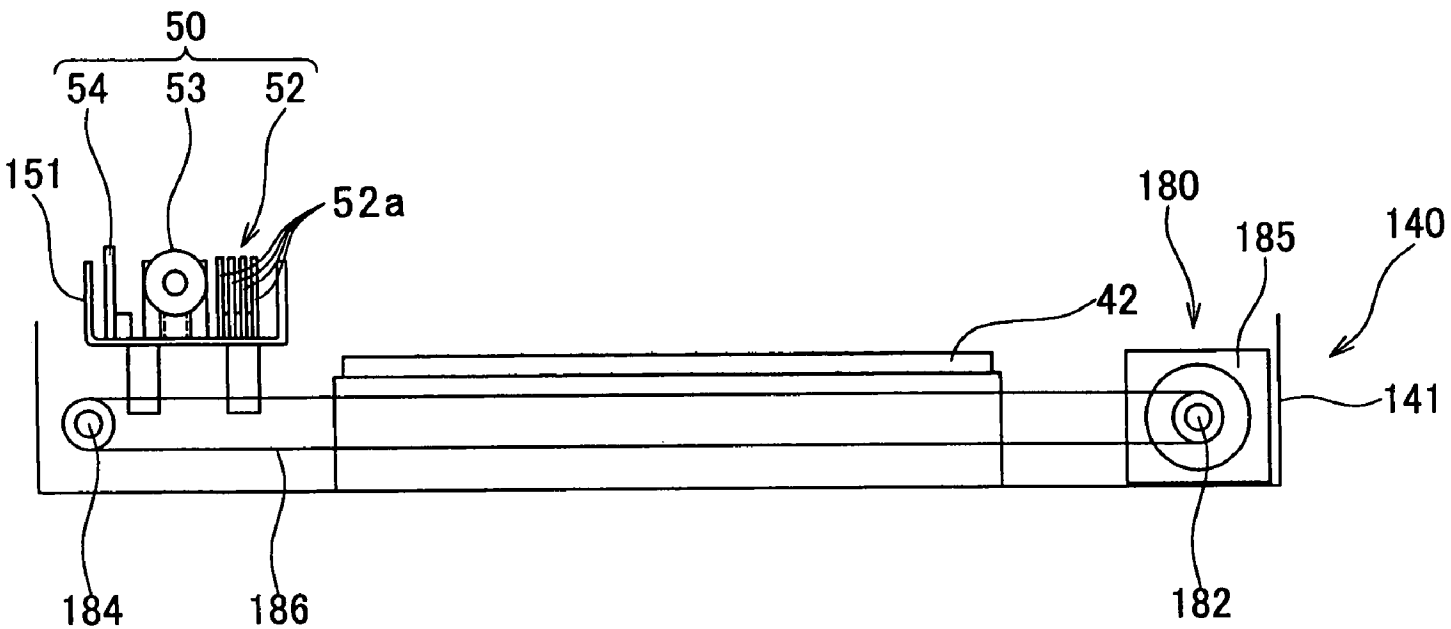
FIG. 8 is a side view of a maintenance unit included in the printer of FIG. 7, seen from an upstream side in a paper conveyance direction.

As illustrated in FIG. 7, the two belts 186 are disposed adjacent to both widthwise ends of a set of the four purge caps 42, and extend in a lengthwise direction of the purge caps 42.

Each of the rollers 182 and 184 is disposed adjacent to a lengthwise end of the purge caps 42 and extends in an arrangement direction of the purge caps 42. The belts 186 are wrapped around both near ends of the respective rollers 182 and 184.

As illustrated in FIG. 7, the motor 185 is connected with one end of the roller 182. As the motor 185 drives, the roller 182 is rotated. Thereby, the two belts 186 concurrently drive, which then causes rotation of the other roller 184 acting as a slave roller. A control unit (not illustrated) of the printer 100 controls the driving of the motor 185.

When seen from a right side of FIG. 8 (i.e., as illustrated in FIG. 7), a frame 151 of the cleaning mechanism 50 is substantially in a shape of inverted-U. Both lower ends of the frame 151 are fixed to the belts 186.

While the purge caps 42, etc., drain ink out of the nozzles, the cleaning mechanism 50 is in such a position as to never confront top fades of the purge caps 42 covering the ink ejection surfaces 12*b*. In more detail, the cleaning mechanism 50 is disposed behind the purge caps 42 in FIG. 7. The belt-type moving mechanism 180 moves the cleaning mechanism 50 in a direction parallel to the ink ejection surfaces 12*b* of the heads 112 and perpendicular to the paper conveyance direction (i.e., in a direction perpendicular to the drawing sheet of FIG. 7), under the condition where the cleaning mechanism 50 is spaced upward from the purge caps 42 and kept out of contact with the purge caps 42. The cleaning mechanism 50 performs an ink removal operation along with this movement.

Then, with reference to FIGS. 9A, 9B, 9C, 9D, 10A, and 10B, there will be described how the conveyance unit 120 and the heads 112 move before maintenance is performed on the heads 112, and how the cleaning mechanism 50 performs a ink removal operation. FIGS. 9A to 9D are front views all seen from the same direction as the direction defined by rotating shafts 22*c* and 24*c* of the belt rollers 22 and 24. A state shown in FIG. 9A corresponds to a state shown in FIG. 7. FIGS. 10A and 10B respectively show FIGS. 9C and 9D seen from a left side thereof. FIGS. 9A to 9D and FIGS. 10A and 10B show each unit in a simplified form.

Figure 9A:
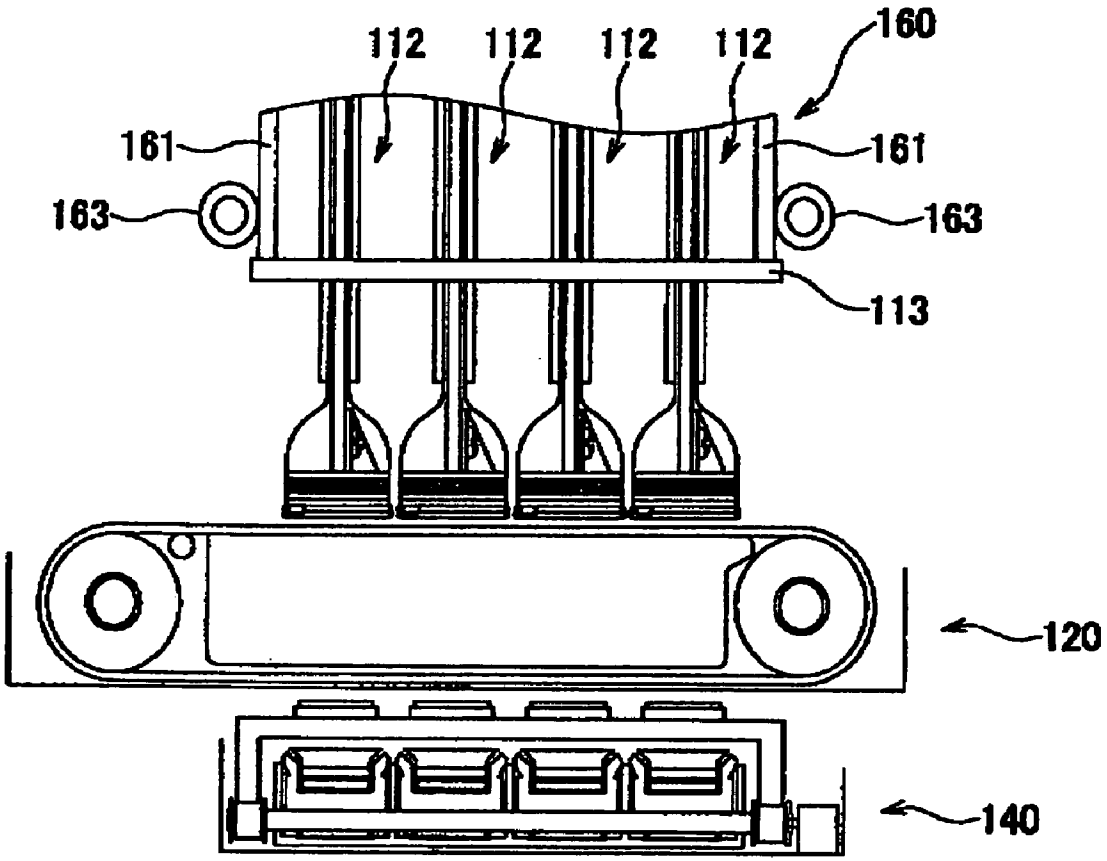
FIGS. 9A, 9B, 9C, and 9D are local front views showing stepwise respective movements of a conveyance unit and heads included in the printer of FIG. 7, before maintenance of heads is performed.
Figure 10A:
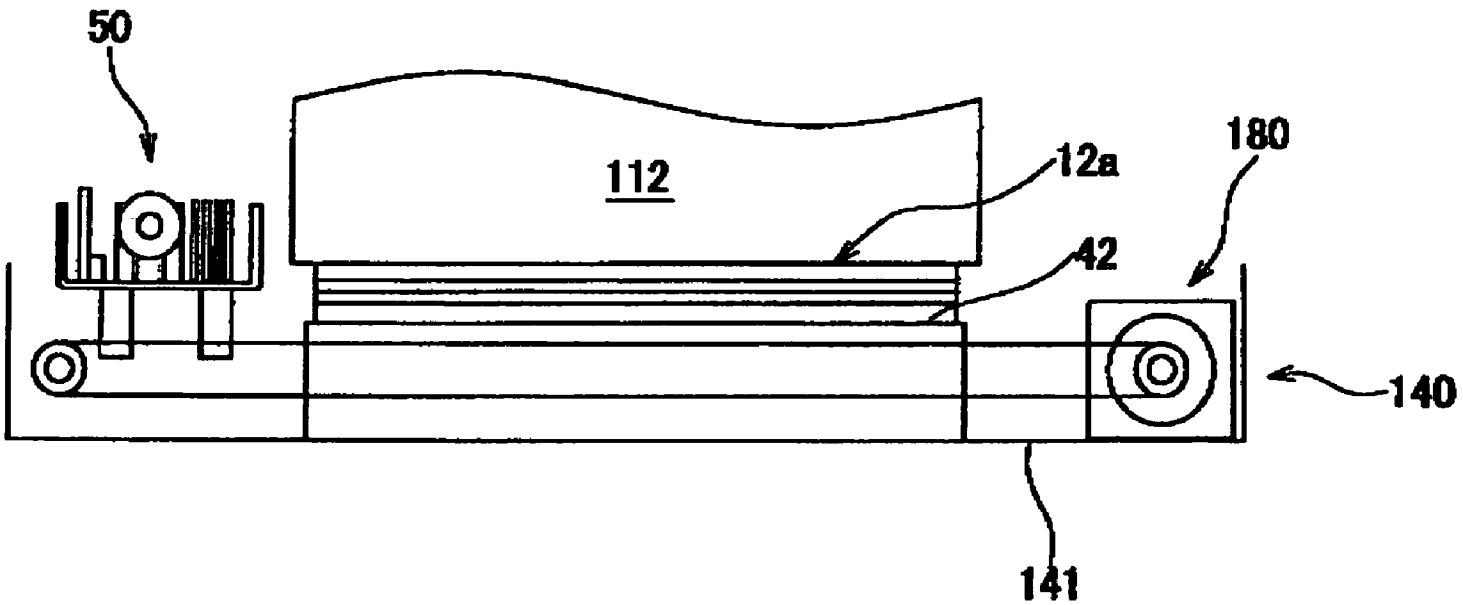
FIGS. 10A and 10B are local side views showing stepwise a movement of a cleaning mechanism mounted on the maintenance unit.
Figure 10B:
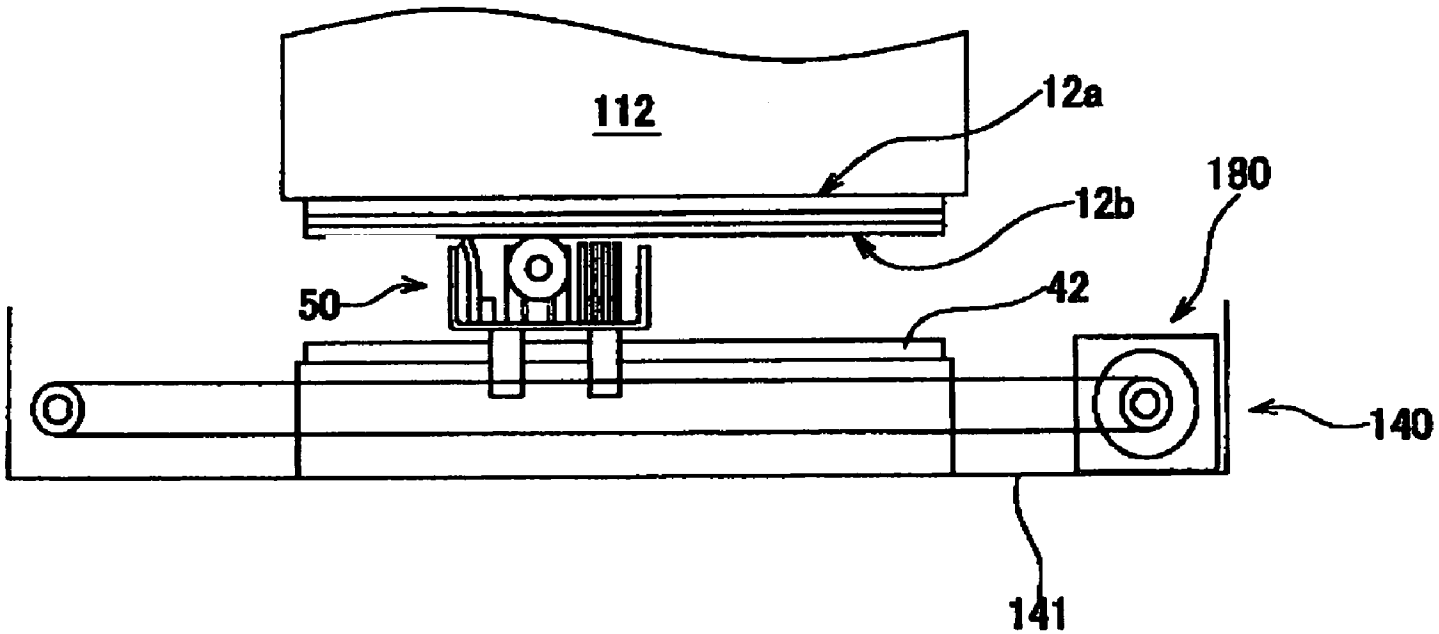

FIG. 9A shows a state where maintenance is not performed on the heads 112. The heads 112, the conveyance unit 120, and the maintenance unit 140 are disposed in this order from the top along the vertical direction. In this state, the conveyance unit 120 takes the "conveyance position", and the heads 112 take the "printing position".

Figure 9B:
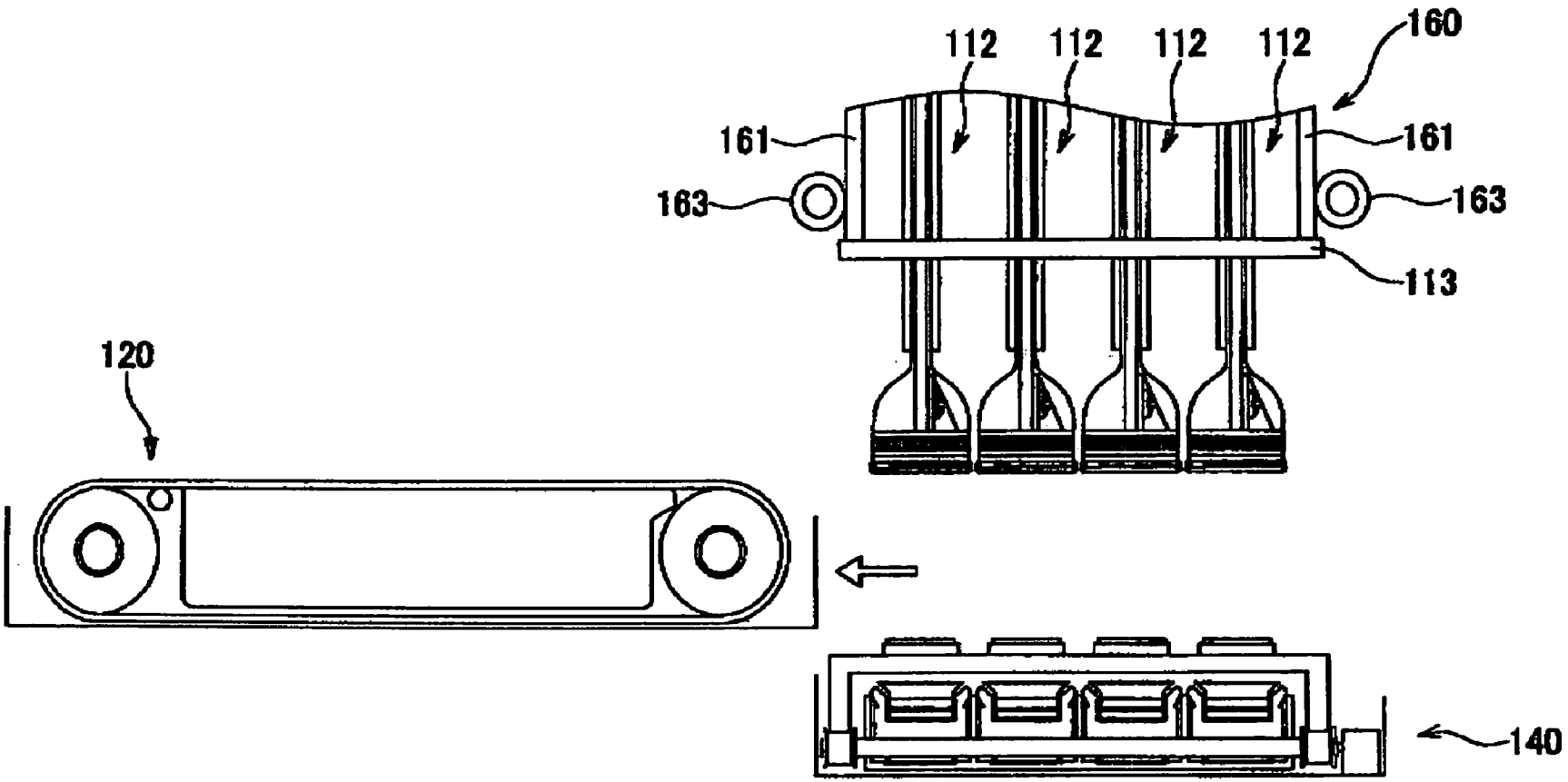

Before the heads 112 are subjected to maintenance, as shown in FIG. 9B, the conveyance unit 120 is horizontally moved along a lengthwise direction of the conveyor belt 26, and to be more specific, moved upstream in the paper conveyance direction.

When the conveyance unit 120 reaches the "withdrawal position", it is kept in this position. Then, the sliding mechanism 160 starts moving the heads 112 downward in the vertical direction. When the conveyance unit 120 is in the "withdrawal position", space where the heads 112 can be disposed is formed vertically above the maintenance unit 140. As a consequence, the heads 112 can be moved without any contact with the conveyance unit 120.

The heads 112 are kept moving vertically downward until they reach the "maintenance position" where, similarly to the first embodiment, the heads 112 can be subjected to maintenance. When the heads 112 are in the "maintenance position", the four purge caps 42 are in close contact with the respective ink ejection surfaces 112*b* of the heads 112 in a covering manner.

Figure 9C:
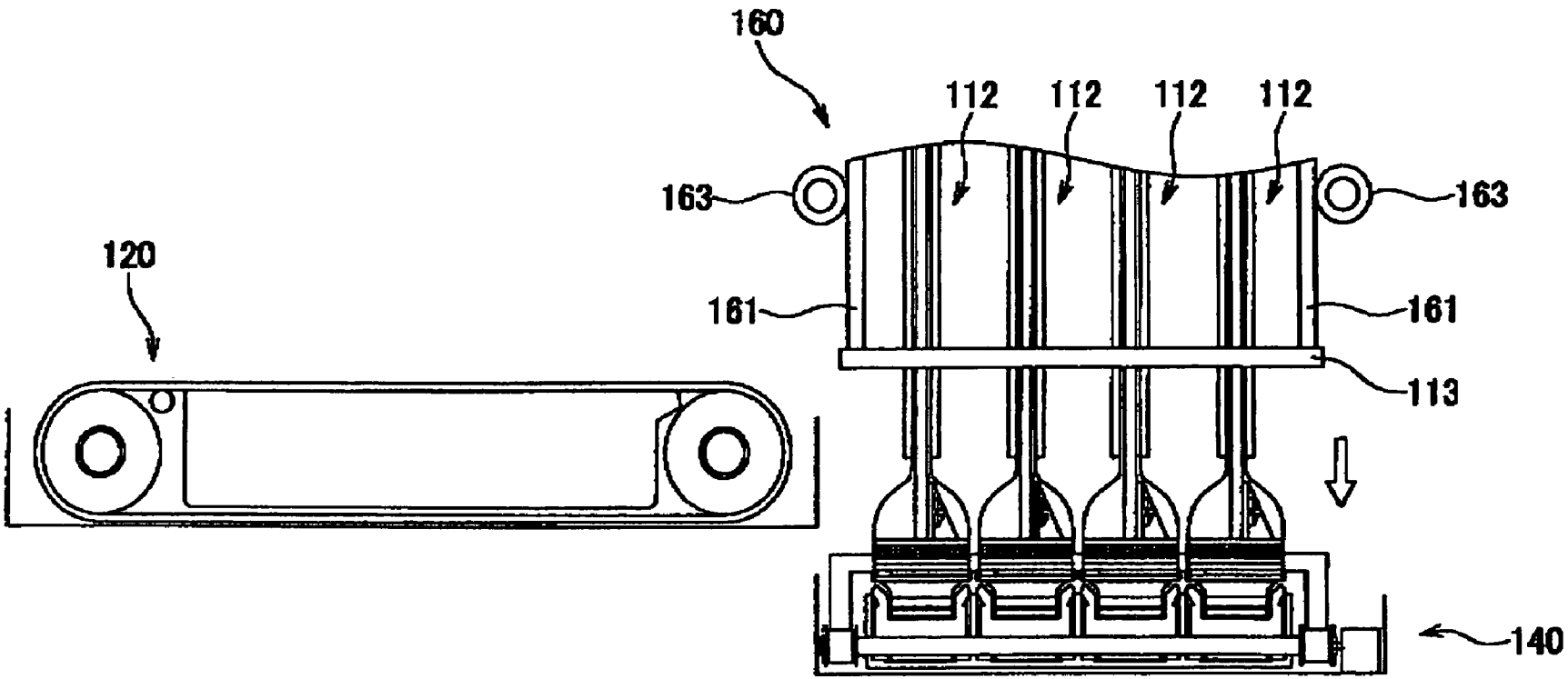

When the heads 112 reach the "maintenance position", the heads 112 are kept in this position, and the maintenance unit 140 performs maintenance on the heads 112 (see FIGS. 9C and 10A).

Figure 9D:
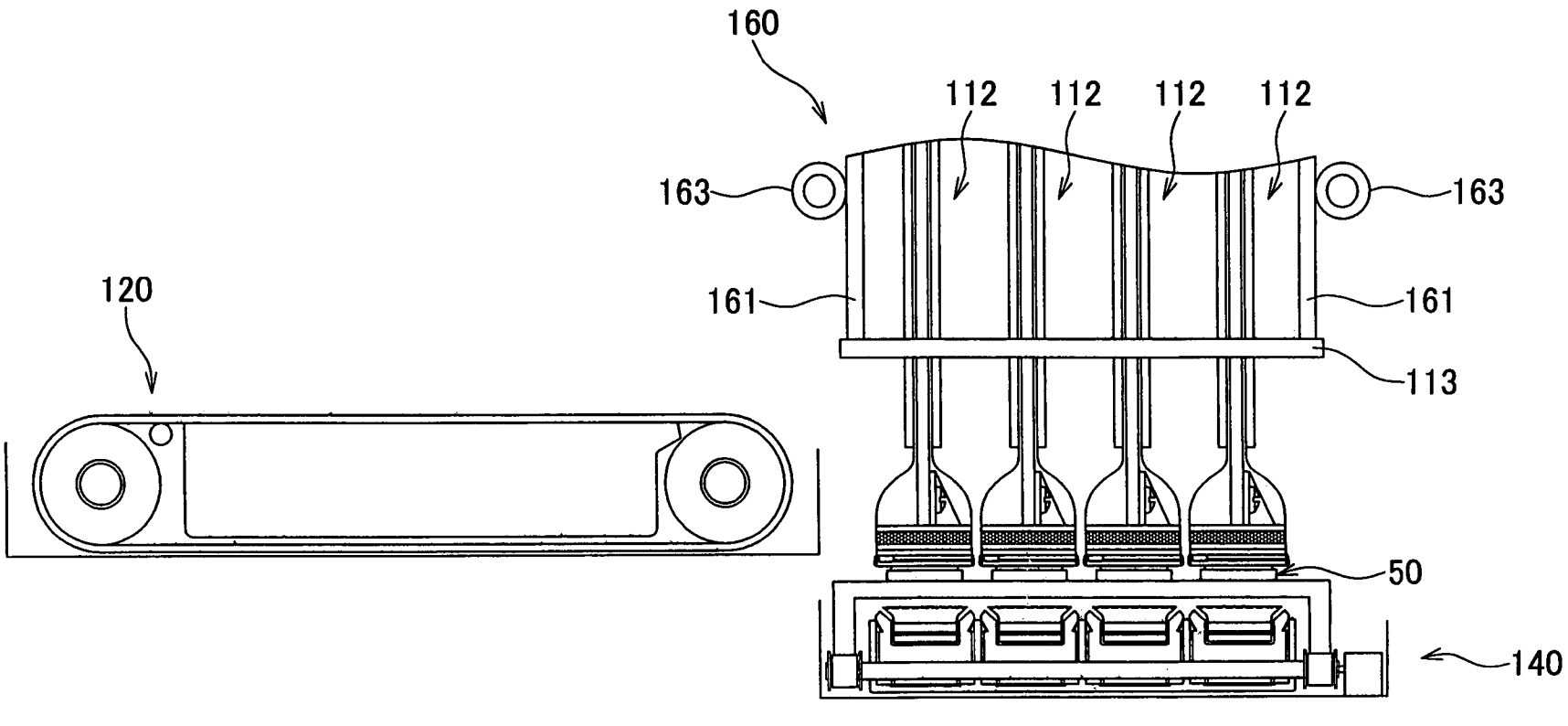

When the maintenance unit 140 completes the maintenance on the heads 112, the sliding mechanism 160 slightly moves the heads 112 upward in the vertical direction to such an extent that the ink ejection surfaces 12*b* may be at a small distance from upper ends of thin plates 52*a* included in the cleaning mechanism 50, as illustrated in FIG. 9D. Subsequently, as illustrated in FIG. 10B, the belt-type moving mechanism 180 moves the cleaning mechanism 50 in a lengthwise direction of the head main bodies 12*a*. Along with this movement, ink adhering onto the ink ejection surfaces 12*b* is removed.

Then, the sliding mechanism 160 moves the heads 112 upward in the vertical direction back into the "printing position", and the belt-type moving mechanism 180 moves the cleaning mechanism 50 back into a position shown in FIG. 10A. Thereafter, the conveyance unit 120 returns to the "conveyance position" shown in FIG. 9A.

As described above, in the ink-jet printer 100 according to the second embodiment of the present invention, during the maintenance of the heads 112, the conveyance unit 120 can be disposed in the "withdrawal position" that is other than a position vertically below the maintenance unit 140. As a result, similarly to the first embodiment, it can advantageously be prevented that ink scattered or leaked out of the maintenance unit 140 adheres to the conveyance unit 120, particularly to the conveyance face 27 of the conveyor belt 26, included in the conveyance unit 120.

In addition, the conveyance unit 120 moves in the horizontal direction, and the heads 112 move in the vertical direction. Therefore, space where a control unit (not illustrated) etc. of the printer 100 may be mounted is formed below the withdrawal position of the conveyance unit 120 and next to the standby position of the maintenance unit 140 (i.e., on a left side of the maintenance unit 140 in FIG. 7). Therefore, similarly to the first embodiment, effective utilization of space is realized within the printer 100, which can prevents the printer 100 from increasing in size.

Moreover, the sliding mechanism 160 is adopted for moving the heads 112 which can therefore be moved smoothly.

Further, the maintenance unit 140 includes the cleaning mechanism 50 as well as the belt-type moving mechanism 180 (see FIG. 8) that moves the cleaning mechanism 50 within the maintenance unit 140. The belt-type moving mechanism 180 keeps the cleaning mechanism 50 spaced from the purge caps 42, and in this condition moves the cleaning mechanism 50 which can thus perform an efficient ink removal operation.

Next, an ink-jet printer according to a third embodiment of the present invention will be described with reference to FIGS. 11 and 12. Here in this embodiment, the same members as those in the first and second embodiments will be denoted by the common reference numerals and will not be described. A printer 200 of this embodiment is, similarly to the first and second embodiments, a line-type color printer.

This embodiment differs from the first and second embodiments mainly in that four heads 212 are arranged not in a horizontal direction but in a vertical direction so that ink ejection surfaces 12*b* are also arranged along the vertical direction. Accordingly, nozzles formed in the ink ejection surfaces 12*b* eject ink in the horizontal direction. An arrangement of the heads 212, a conveyance unit 220, and a maintenance unit 240 of this embodiment is obtained by rotating clockwise by 90 degrees the corresponding units of the first and second embodiments.

In this embodiment, as in the first embodiment, the maintenance unit 240 is movable and positions of the heads 212 are fixed. Similarly to the second embodiment, a cleaning mechanism 50 is mounted on the maintenance unit 240, and can be moved in a direction parallel to the ink ejection surfaces 12*b* of: the heads 212 and perpendicular to a paper conveyance direction (i.e., in a direction perpendicular to the drawing sheet in FIG. 11) by means of the same mechanism as the belt-type moving mechanism 180 of the second embodiment.

Figure 12:
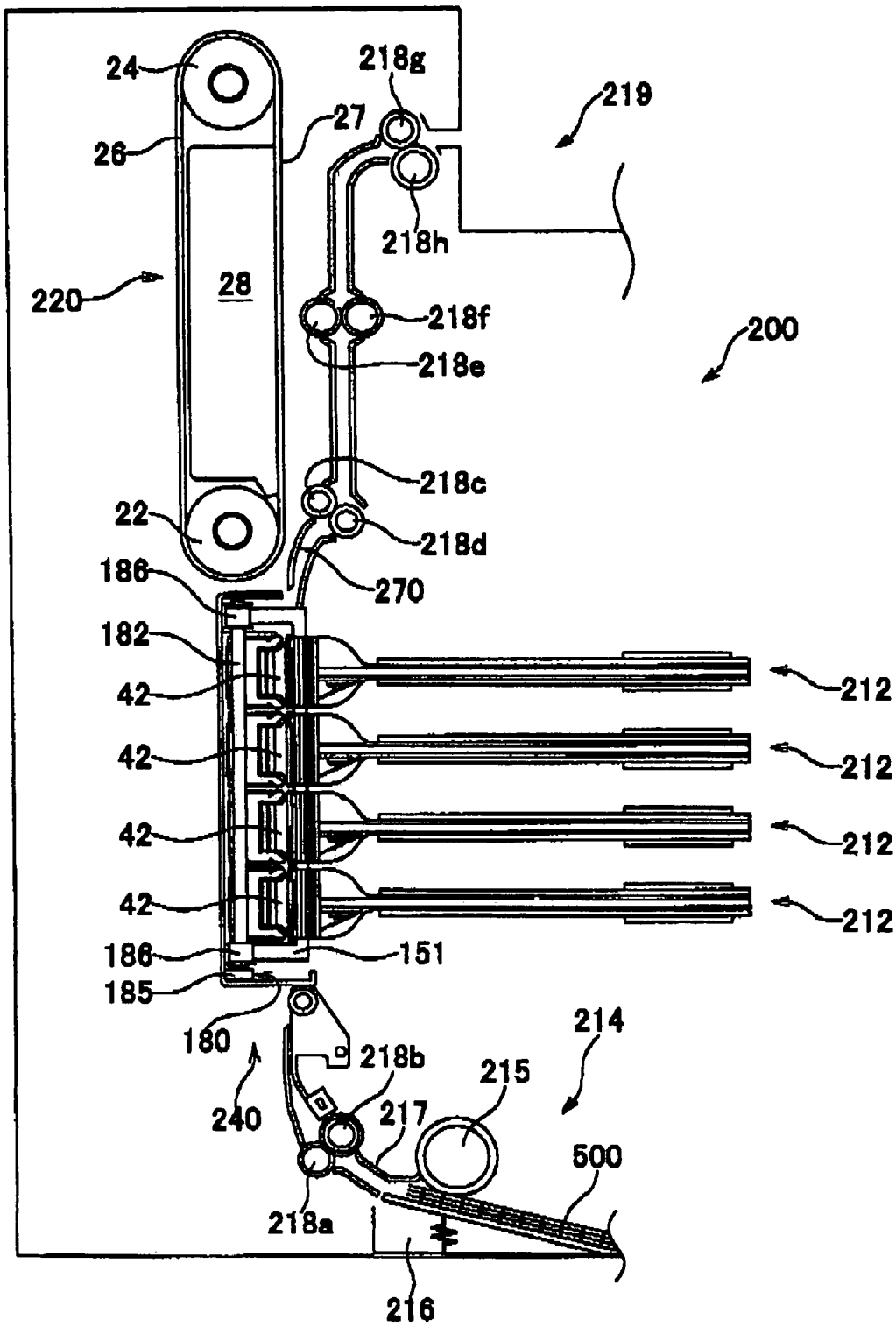
FIG. 12 is a front view showing that a maintenance unit is performing maintenance on heads in the printer of FIG. 11.

The same mechanism (not illustrated) as the moving mechanism 30 of the first embodiment moves the conveyance unit 220 in the vertical direction along a lengthwise direction of a conveyor belt 26, i.e., in parallel to the ink ejection surfaces 12*b* (see FIG. 12).

Figure 11:
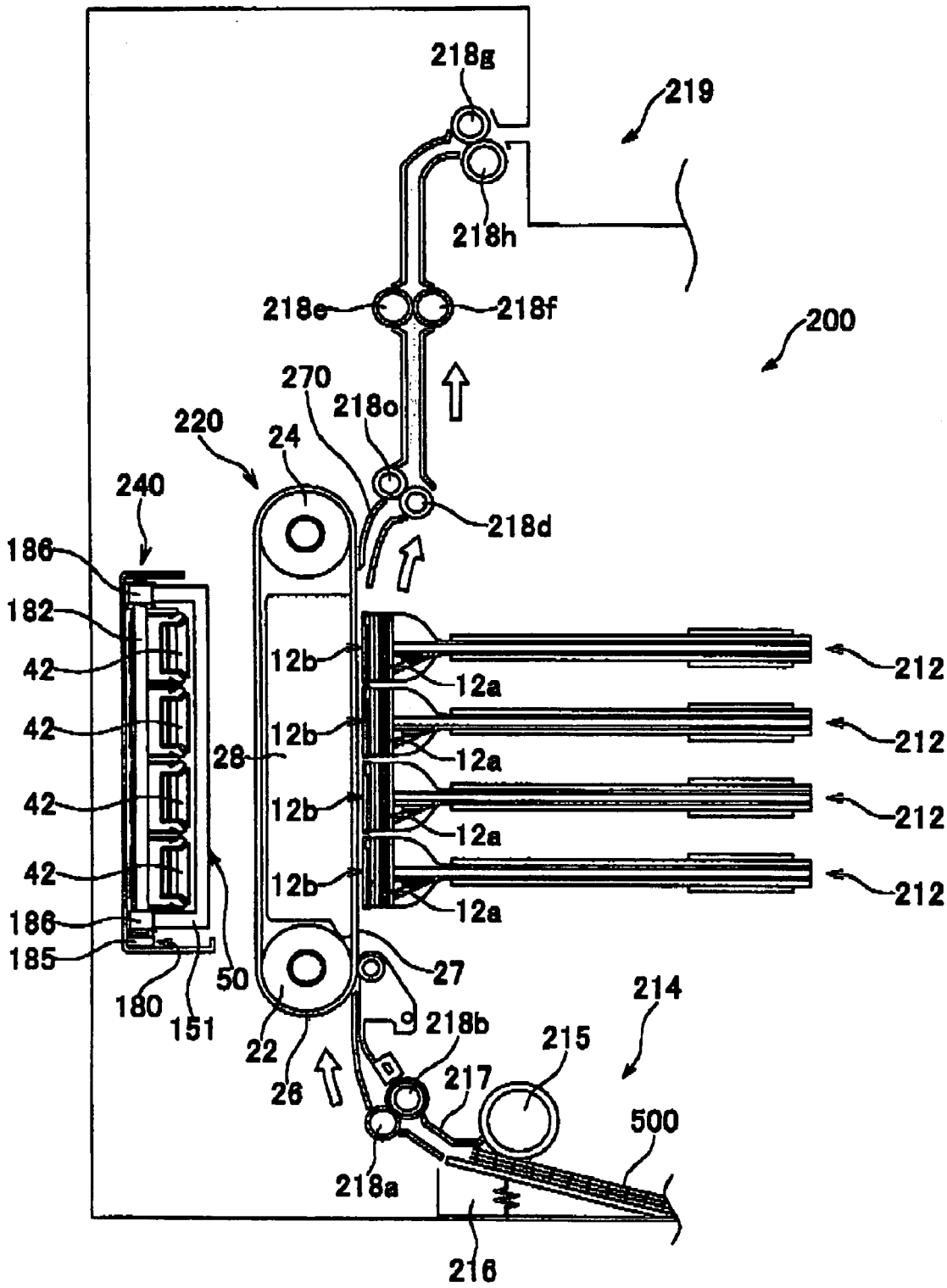
FIG. 11 is a front view showing a general structure of an ink-jet printer according to a third embodiment of the present invention.

In this embodiment, differently from the first and second embodiments, a "withdrawal position" of the conveyance unit 220 locates vertically above its "conveyance position" shown in FIG. 11. That is, the conveyance unit 220 is moved upward in the vertical direction before maintenance of heads 212, and is moved downward in the vertical direction after completion of the maintenance.

The printer 200 comprises a paper feed unit 214 and a paper discharge unit 219. Within the printer 200, formed is a paper conveyance path as indicated by arrows in FIG. 11 that extends substantially in the vertical direction from the paper feed unit 214 through space between the heads 212 and the conveyance unit 220 to the paper discharge unit 219.

The paper feed unit 214 includes a paper container 216 capable of accommodating a plurality of papers in a stacked manner, and a paper feed roller 215 that sends out a topmost paper 500 among the plurality of papers stocked in the paper container 216. A guide plate 217 guides the paper that has been sent out by the paper feed roller 215, so that the paper is delivered onto a conveyor belt 26 of the conveyance unit 220 by a first pair of rollers 21*a* and 21*b*.

The paper 500 having been delivered onto the conveyor belt 26 is held on the conveyance face 27 and, in this condition, conveyed upward in the vertical direction.

A peeling plate 270 is disposed near a belt roller 24 of the conveyance unit 220 where the conveyor belt 26 is wrapped. The peeling plate 270 peels a paper from a conveyance face 27 of the conveyor belt 26. The paper is subsequently conveyed by a second pair of rollers 218*c* and 218*d*, and-a third pair of rollers 218*e* and 218*f*, and a fourth pair of rollers 218*g* and 218*h*, in this order, to be then discharged into a paper discharge unit 219.

In the maintenance unit 240, the four purge cape 42 are arranged in the vertical direction in correspondence to the respective heads 212.

Except when the maintenance unit 240 performs maintenance on the heads 212, the maintenance unit 240 is in a "standby position", where a distance between the maintenance unit 240 and the ink ejection surfaces 12*b* is larger than that in a "maintenance position". When the maintenance unit 240 is to perform maintenance, the same mechanism (not illustrated) as the sliding mechanism 60 (see FIG. 5) of the first embodiment moves the maintenance unit 240 horizontally toward the ink ejection surfaces 12*b* of the heads 212 (i.e., rightward in FIG. 11), into the "maintenance position".

After a completion of the maintenance of the heads 212, the maintenance unit 240 is slightly moved to such as extent that the ink ejection surfaces 12*b* may be at a small distance from upper ends of thin plates 52*a* included in the cleaning mechanism 50. Then, similarly to the second embodiment, a belt-type moving mechanism 180 moves the cleaning mechanism 50, and along with this movement ink adhering onto the ink ejection surfaces 12*b* is removed.

As described above, in the ink-jet printer 200 according to the third embodiment of the present invention, during the maintenance of the heads 212, the conveyance unit 220 can be disposed in the "withdrawal position" that is other than a position vertically below the maintenance unit 240. As a result, similarly to the first and second embodiments, it can advantageously be prevented that ink scattered or leaked out of the maintenance unit 240 adheres to the conveyance unit 220, particularly to the conveyance face 27 of the conveyor belt 26 included in the conveyance unit 220.

During, before, and after the maintenance, the heads, the conveyance unit, and the maintenance unit can be, for example, arranged in various manners, moved in various directions, and with or without movement, as far as the conveyance unit is disposed in a withdrawal position that is other than a position vertically below the maintenance unit while the maintenance unit performs maintenance on heads.

For example, not only the conveyance unit but also the heads may be moved by a moving mechanism, while the aforementioned embodiments adopt the moving mechanism 30 that moves the conveyance unit only.

In the third embodiment, the maintenance unit 240 may be disposed vertically below the conveyance unit 220 when it does not perform maintenance, and before it starts maintenance the conveyance unit 220 is moved in the horizontal direction (leftward in FIG. 11), followed by an upward movement of the maintenance unit 240 in the vertical direction. In the third embodiment, moreover, the heads 212 may be moved as in the second embodiment with the maintenance unit 240 being fixed in its position. In the aforementioned first to third embodiments, of the heads and the maintenance unit, one is fixed and the other moves toward or away from the other. However, both the heads and the maintenance unit may move toward or away from each other.

The moving mechanism 30 of the first embodiment and the sliding mechanisms 60 and 160 in the first and second embodiments may respectively move the conveyance unit or both the conveyance unit and the heads, and the heads and/or the maintenance unit, not only in the horizontal and vertical directions but also in any other directions forming various angles with the horizontal plane. When under such conditions the cleaning mechanism is to be mounted on the conveyance unit as in the first embodiment, it is preferable to suitably alter an arrangement of the cleaning mechanism in order to obtain a good ink removal operation by the cleaning mechanism.

The ink ejection surface of the heads may not necessarily be disposed in the horizontal and vertical directions, and may be disposed at various angles with the horizontal plane.

The moving mechanism 30 of the first embodiment and the sliding mechanisms 60 and 160 in the first and second embodiments may adopt various structures, as far as they can move their corresponding units and one never hinders a movement of the other. To be more specific, in the sliding mechanisms 60 and 160 (see FIGS. 5 and 7), instead of the guide shafts 61 and the guide columns 161, a belt may be used so as to be wrapped around the rotating cam 62 or the gears 163. The maintenance unit or the heads fixed to the belt can be moved in association with rotation of the belt. Furthermore, instead of the sliding mechanisms 60 and 160, the bolt-shaped supporting column 32*a* included in the moving mechanism 30 (see FIGS. 3 and 4) of the first embodiment may be used so as to play a role of both the guide member and the rotating member.

Each of the members 52, 53, and 54 (see FIG. 2) of the cleaning mechanism 50 may not necessarily be divided into four sections each corresponding to each head, and may be longer than the width of the whole four heads that are arranged in parallel. Further, it is not always required that the cleaning mechanism 50 includes the ink receiving member 52, the wiping roller 53, and the blade 54. The cleaning mechanism 50 may only include one or two of these three members, and alternatively may include an appropriate member other than these three. Like this, various structures are acceptable.

A moving direction of the cleaning mechanism 50 is not limited to the direction parallel to the ink ejection surfaces 12*b* and perpendicular to the paper conveyance direction, i.e., the direction perpendicular to the arrangement direction of the heads, as described in the aforementioned embodiments. For a color printer in which inks of different colors are ejected from respective heads as in the aforementioned embodiments, it is advantageous to move the cleaning mechanism 50 in a direction perpendicular to an arrangement direction of the heads in order to prevent the different color inks from mixing with one another. However, insofar as no trouble is involved in printing, the cleaning mechanism 50 may move in the arrangement direction of the heads (for example, in a lateral direction in FIG. 1).

The cleaning mechanism 50 can be mounted either on the conveyance unit or on the maintenance unit. Alternatively, the cleaning mechanism 50 may not necessarily be mounted on these units and may form an individual mechanism to be movably disposed within the printer. For example, in the second embodiment, the belt-type moving mechanism 180 (see FIG. 8) may be omitted so that the cleaning mechanism 50 is disposed adjacent to the purge caps 42, which as a whole forms a maintenance unit.

The maintenance unit may perform maintenance on the heads not only by as in the aforementioned embodiments, bringing the purge caps 42 into close contact with the ink ejection surfaces 12*b* and then causing auction force within the caps 42 so that ink can be drained out of the nozzles using the suction force. For example, there may be adopted a so-called pressurized purge for applying pressure to ink within ink passages of heads to thereby drain ink out of the nozzles. In the case of the pressurized purge, it is not necessary to bring the purge caps 42 into close contact with the ink ejection surfaces 12*b*. The maintenance of the heads is not limited to the aforementioned forcible ejection of ink within the nozzles. The maintenance of the heads may be, e.g., an ink removable operation by the cleaning mechanism 50, a combination of the above-mentioned forcible ink ejection and the ink removable operation, and other various methods.

Materials of the conveyor belt, the respective components of the cleaning mechanism, and the like are not limited to the above-described ones, and may properly be changed for design conveniences.

In addition, it is not always required that the conveyance unit conveys a paper by means of the conveyor belt 26. The conveyance unit can convey a paper with the paper being in close contact with a cylindrical drum, for example.

The number of heads included in the printer is not limited to four, and the printer is not limited to color printers.

Further, the application of the present invention is not limited to an ink-jet printer. The present invention is also applicable, for example, to an ink-jet type facsimile or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus for forming an image on a recording medium by ejecting ink onto the recording medium, comprising:

a conveyance unit that forms a conveyance face on which the recording medium is conveyed;

an ink-jet head that has an ink ejection surface where a plurality of nozzles that eject ink are formed;

a maintenance unit that performs maintenance on the ink-jet head;

a first moving mechanism that moves the conveyance unit, so that the conveyance unit can selectively take a conveyance position where the conveyance face is adjacent to the ink ejection surface and a withdrawal position that is other than a position where the conveyance face is adjacent to the ink ejection surface; and a second moving mechanism that moves at least one of the ink-jet head and the maintenance unit relative to the other, so that the ink-jet head and the maintenance unit selectively have a positional relationship for maintenance where the ink ejection surface is adjacent to the maintenance unit and a positional relationship for standby where a distance between the maintenance unit and the ink ejection surface is larger than that in the positional relationship for maintenance, wherein the ink ejection surface extends in a horizontal direction; and the first moving mechanism moves the conveyance unit in the horizontal direction.

2. The ink-jet recording apparatus according to claim 1, wherein the conveyance unit in the withdrawal position is distant from the maintenance unit in a plan view.

3. The ink-jet recording apparatus according to claim 1, wherein the maintenance unit is located vertically below the ink-jet head when the ink-jet head and the maintenance unit have the positional relationship for standby.

4. The ink-jet recording apparatus according to claim 1, wherein:

the first moving mechanism includes a plurality of support members that support the conveyance unit and, in this condition, guide the conveyance unit in a moving direction thereof; and at least one of the plurality of support members is bolt-shaped with a screw thread formed on its outer surface, to thereby move the conveyance unit with its rotation.

5. The ink-jet recording apparatus according to claim 4, wherein a support member other than the bolt-shaped one supports the conveyance unit in a slidable manner.

6. The ink-jet recording apparatus according to claim 1, wherein the ink-jet head and the maintenance unit are located away from a path through which the conveyance unit is moved by the first moving mechanism when the ink-jet head and the maintenance unit have the positional relationship for standby.

7. The ink-jet recording apparatus according to claim 1, wherein the second moving mechanism has a sliding mechanism capable of sliding the maintenance unit.

8. The ink-jet recording apparatus according to claim 7, wherein the sliding mechanism includes:

a rotating member that rotates to move the maintenance unit; and a guide member that guides the maintenance unit in the moving direction thereof.

9. The ink-jet recording apparatus according to claim 1, wherein the second moving mechanism has a sliding mechanism capable of sliding the ink-jet head.

10. The ink-jet recording apparatus according to claim 9, wherein the sliding mechanism includes:

a rotating member that rotates to move the ink-jet head; and a guide member that guides the ink-jet head in the moving direction thereof.

11. The ink-jet recording apparatus according to claim 1, wherein:

the maintenance unit has a purge cap mounted thereon which covers the ink ejection surface and, in this condition, receives ink forcibly drained out of the nozzles; and the conveyance unit has a cleaning mechanism mounted thereon which removes ink adhering onto the ink ejection surfaces.

12. The ink-jet recording apparatus according to claim 11, wherein:

the first moving mechanism moves the conveyance unit in parallel to the ink ejection surface; and along with a movement of the conveyance unit by the first moving mechanism, the cleaning mechanism removes ink adhering onto the ink ejection surface.

13. The ink-jet recording apparatus according to claim 12, wherein the cleaning mechanism removes ink adhering onto the ink ejection surface, when the conveyance unit is moved by the first moving mechanism both from the conveyance position into the withdrawal position and from the withdrawal position into the conveyance position.

14. The ink-jet recording apparatus according to claim 11, wherein the cleaning mechanism includes an ink receiving member that has a plurality of protruding portions and brings the protruding portions into contact with ink adhering onto the ink ejection surface to thereby receive the ink between the protruding portions.

15. The ink-jet recording apparatus according to claim 11, wherein the cleaning mechanism includes a wiping roller that comes in contact with the ink ejection surface to, with its rotation, wipe off ink adhering onto the ink ejection surface.

16. The ink-jet recording apparatus according to claim 11, wherein the cleaning mechanism includes a blade that is formed of a flexible material and comes into contact with the ink ejection surface so that its upper end is bent, and in this condition wipes off ink adhering onto the ink ejection surface.

17. The ink-jet recording apparatus according to claim 11, wherein the cleaning mechanism included in the conveyance unit is moved in a direction parallel to the ink ejection surface and perpendicular to a conveyance direction of a recording medium.

18. The ink-jet recording apparatus according to claim 1, wherein the maintenance unit includes:

a purge cap that covers the ink ejection surface and, in this condition, receives ink forcibly drained out of the nozzles;

a cleaning mechanism that removes ink adhering onto the ink ejection surface; and a third moving mechanism that moves the cleaning mechanism within the maintenance unit.

19. The ink-jet recording apparatus according to claim 18, wherein the third mechanism moves the cleaning mechanism in a direction parallel to the ink ejection surface and perpendicular to a conveyance direction of a recording medium.

20. The ink-jet recording apparatus according to claim 18, wherein, while the purge cap receives the ink forcibly drained out of the nozzles, the cleaning mechanism is in a position other than such a position as to confront a face of the purge cap covering the ink ejection surface.

21. The ink-jet recording apparatus according to claim 18, wherein the third moving mechanism includes:

a belt to which the cleaning mechanism is fixed so that the cleaning mechanism can move along with a driving of the belt;

two or more rollers between which the belt is stretched; and a motor that rotates at least one of the rollers in order to drive the belt.

22. The ink-jet recording apparatus according to claim 21, wherein:

the belt is disposed adjacent to each of widthwise ends of the purge cap and extends in a lengthwise direction of the purge cap; and the cleaning mechanism, having its ends fixed to the respective belts, performs an ink removal operation with moving at a distance from the purge cap.

23. The ink-jet recording apparatus according to claim 1, wherein the ink-jet head is a line-type one that has a width larger than or equal to that of a recording medium and performs a printing during its movement relative to the recording medium.

* * * * *